US009211628B2

(12) United States Patent
Allison et al.

(10) Patent No.: US 9,211,628 B2
(45) Date of Patent: Dec. 15, 2015

(54) POLISHING PAD WITH CONCENTRIC OR APPROXIMATELY CONCENTRIC POLYGON GROOVE PATTERN

(75) Inventors: William C. Allison, Beaverton, OR (US); Diane Scott, Portland, OR (US); Alexander William Simpson, Hillsboro, OR (US)

(73) Assignee: NexPlanar Corporation, Hillsboro, OR (US)

( * ) Notice: Subject to any disclaimer, the term of this patent is extended or adjusted under 35 U.S.C. 154(b) by 1213 days.

(21) Appl. No.: 13/014,630

(22) Filed: Jan. 26, 2011

(65) Prior Publication Data

US 2012/0190281 A1 Jul. 26, 2012

(51) Int. Cl.
*B24B 37/00* (2012.01)
*B24B 37/26* (2012.01)

(52) U.S. Cl.
CPC ..... *B24B 37/26* (2013.01)

(58) Field of Classification Search
CPC ..... B24B 37/26
USPC ..... 451/529, 56, 41
See application file for complete search history.

(56) References Cited

U.S. PATENT DOCUMENTS

| | | | | |
|---|---|---|---|---|
| 1,862,103 | A * | 6/1932 | Stratford | 451/529 |
| 6,120,366 | A * | 9/2000 | Lin et al. | 451/550 |
| 7,029,747 | B2 * | 4/2006 | Huh et al. | 428/217 |
| 7,097,550 | B2 * | 8/2006 | Kawahara et al. | 451/526 |
| 7,125,318 | B2 * | 10/2006 | Muldowney | 451/41 |
| 7,140,955 | B2 * | 11/2006 | Nabeya | 451/287 |
| 7,234,224 | B1 * | 6/2007 | Naugler et al. | 29/557 |
| 7,300,340 | B1 * | 11/2007 | Elmufdi et al. | 451/527 |
| D559,066 | S * | 1/2008 | Tano et al. | D8/70 |
| 7,329,174 | B2 * | 2/2008 | Hosaka et al. | 451/527 |
| 7,357,703 | B2 * | 4/2008 | Nishimura et al. | 451/527 |
| 8,439,994 | B2 * | 5/2013 | Allison et al. | 51/293 |
| 2004/0014413 | A1 | 1/2004 | Kawahashi et al. | |
| 2005/0090187 | A1 * | 4/2005 | Shih et al. | 451/6 |
| 2005/0113011 | A1 * | 5/2005 | Miyauchi et al. | 451/527 |
| 2005/0260928 | A1 | 11/2005 | Huh et al. | |
| 2005/0260942 | A1 * | 11/2005 | Kawahara et al. | 451/527 |
| 2007/0077862 | A1 | 4/2007 | Swedek et al. | |
| 2009/0053976 | A1 | 2/2009 | Roy et al. | |
| 2009/0094900 | A1 | 4/2009 | Swisher et al. | |
| 2009/0104849 | A1 * | 4/2009 | Wang | 451/11 |
| 2009/0311955 | A1 | 12/2009 | Kerprich et al. | |
| 2010/0009601 | A1 | 1/2010 | Wang | |

(Continued)

FOREIGN PATENT DOCUMENTS

| | | |
|---|---|---|
| EP | 0878270 | 11/1998 |
| EP | 1447841 | 8/2004 |

(Continued)

OTHER PUBLICATIONS

International Search Report and Written Opinion from PCT/US2012/021899 mailed May 14, 2012, 13 pgs.

(Continued)

*Primary Examiner* — Maurina Rachuba
(74) *Attorney, Agent, or Firm* — Blakely Sokoloff Taylor Zafman LLP

(57) ABSTRACT

Polishing pads with concentric or approximately concentric polygon groove patterns are described. Methods of fabricating polishing pads with concentric or approximately concentric polygon groove patterns are also described.

19 Claims, 17 Drawing Sheets

(56) References Cited

U.S. PATENT DOCUMENTS

| | | | | |
|---|---|---|---|---|
| 2010/0035529 | A1 | 2/2010 | Kulp et al. | |
| 2010/0330879 | A1 | 12/2010 | Paik et al. | |
| 2011/0165364 | A1 | 7/2011 | Seth | |
| 2012/0079773 | A1* | 4/2012 | Allison et al. | 51/296 |
| 2012/0083191 | A1* | 4/2012 | Allison et al. | 451/526 |
| 2012/0083192 | A1* | 4/2012 | Allison et al. | 451/526 |
| 2012/0190281 | A1* | 7/2012 | Allison et al. | 451/527 |
| 2012/0282849 | A1* | 11/2012 | Kerprich et al. | 451/527 |

FOREIGN PATENT DOCUMENTS

| | | |
|---|---|---|
| EP | 1529598 | 5/2005 |
| JP | 2003516872 | 5/2003 |
| JP | 2004009156 | 1/2004 |
| JP | 2004146704 | 5/2004 |
| JP | 2005159340 | 6/2005 |
| JP | 2008546167 | 12/2008 |
| JP | 2010041056 | 2/2010 |
| KR | 1020050042738 | 5/2005 |
| TW | I274631 | 3/2007 |
| TW | 200726573 | 7/2007 |
| TW | 200918243 | 5/2009 |
| TW | 201002474 | 1/2010 |
| WO | WO-0143920 | 6/2001 |
| WO | WO-2006089293 | 8/2006 |

OTHER PUBLICATIONS

International Preliminary Report on Patentability from PCT/US2012/021899 mailed Aug. 8, 2013, 9 pgs.
First Written Opinion from Singapore Patent Application No. 201200479-2, mailed Nov. 7, 2012, 10 pgs.
Second Written Opinion from Singapore Patent Application No. 201200479-2, mailed Aug. 9, 2013, 10 pgs.
Office Action for Japanese Patent Application No. 2013-552021, mailed Jun. 12, 2014, 6 pgs.
Office Action from Japanese Patent Application No. 2013222021, mailed Nov. 28, 2014 5 pgs.
Office Action from Korean Patent Application No. 1020137020419 mailed Feb. 2, 2015, 8 pgs.
Taiwan Search Report from TW 101102753 August 23, 2014, 1 pgs.
Office Action from Chinese Application No. 201280013062.5 mailed Mar. 30, 2015, 4 pgs.
Decision of Final Rejection from Korean Patent Application No. 10-2013-7020419 mailed Sep. 14, 2015, 8 pgs.
Decision of Rejection from Taiwanese Patent Application No. 101102753 mailed Jul. 17, 2015, 3 pgs.

* cited by examiner

POLISHING PAD WITH CONCENTRIC OR APPROXIMATELY CONCENTRIC POLYGON GROOVE PATTERN

TECHNICAL FIELD

Embodiments of the present invention are in the field of chemical mechanical polishing (CMP) and, in particular, polishing pads with concentric or approximately concentric polygon groove patterns.

BACKGROUND

Chemical-mechanical planarization or chemical-mechanical polishing, commonly abbreviated CMP, is a technique used in semiconductor fabrication for planarizing a semiconductor wafer or other substrate.

The process uses an abrasive and corrosive chemical slurry (commonly a colloid) in conjunction with a polishing pad and retaining ring, typically of a greater diameter than the wafer. The polishing pad and wafer are pressed together by a dynamic polishing head and held in place by a plastic retaining ring. The dynamic polishing head is rotated during polishing. This approach aids in removal of material and tends to even out any irregular topography, making the wafer flat or planar. This may be necessary in order to set up the wafer for the formation of additional circuit elements. For example, this might be necessary in order to bring the entire surface within the depth of field of a photolithography system, or to selectively remove material based on its position. Typical depth-of-field requirements are down to Angstrom levels for the latest sub-50 nanometer technology nodes.

The process of material removal is not simply that of abrasive scraping, like sandpaper on wood. The chemicals in the slurry also react with and/or weaken the material to be removed. The abrasive accelerates this weakening process and the polishing pad helps to wipe the reacted materials from the surface. In addition to advances in slurry technology, the polishing pad plays a significant role in increasingly complex CMP operations.

However, additional improvements are needed in the evolution of CMP pad technology.

SUMMARY

Embodiments of the present invention include polishing pads with concentric or approximately concentric polygon groove patterns.

In an embodiment, a polishing pad for polishing a substrate includes a polishing body. The polishing body has a polishing surface and a back surface. The polishing surface has a pattern of grooves including concentric or approximately concentric polygons. The pattern of grooves has no radial groove continuous from the inner most polygon to the outer most polygon.

In another embodiment, a method of fabricating a polishing pad for polishing a substrate includes mixing a pre-polymer and a curative to form a mixture in the base of a formation mold. The lid of the formation mold is moved into the mixture. The lid has disposed thereon a pattern of protrusions including concentric or approximately concentric polygons. The pattern of protrusions has no radial protrusion continuous from the inner most polygon to the outer most polygon. With the lid placed in the mixture, the mixture is at least partially cured to form a molded homogeneous polishing body including a polishing surface having disposed therein a pattern of grooves corresponding to the pattern of protrusions of the lid.

In another embodiment, a polishing pad for polishing a substrate includes a polishing body. The polishing body has a polishing surface and a back surface. The polishing surface has a pattern of grooves including a plurality of discrete linear segments orthogonal to radii of the polishing surface and forming a portion of a, but not a complete, concentric or approximately concentric polygon arrangement.

In another embodiment, a polishing pad for polishing a substrate includes a polishing body. The polishing body has a polishing surface and a back surface. The polishing surface has a pattern of grooves including nested incomplete polygons having continuity there between.

DETAILED DESCRIPTION

Figure 1:
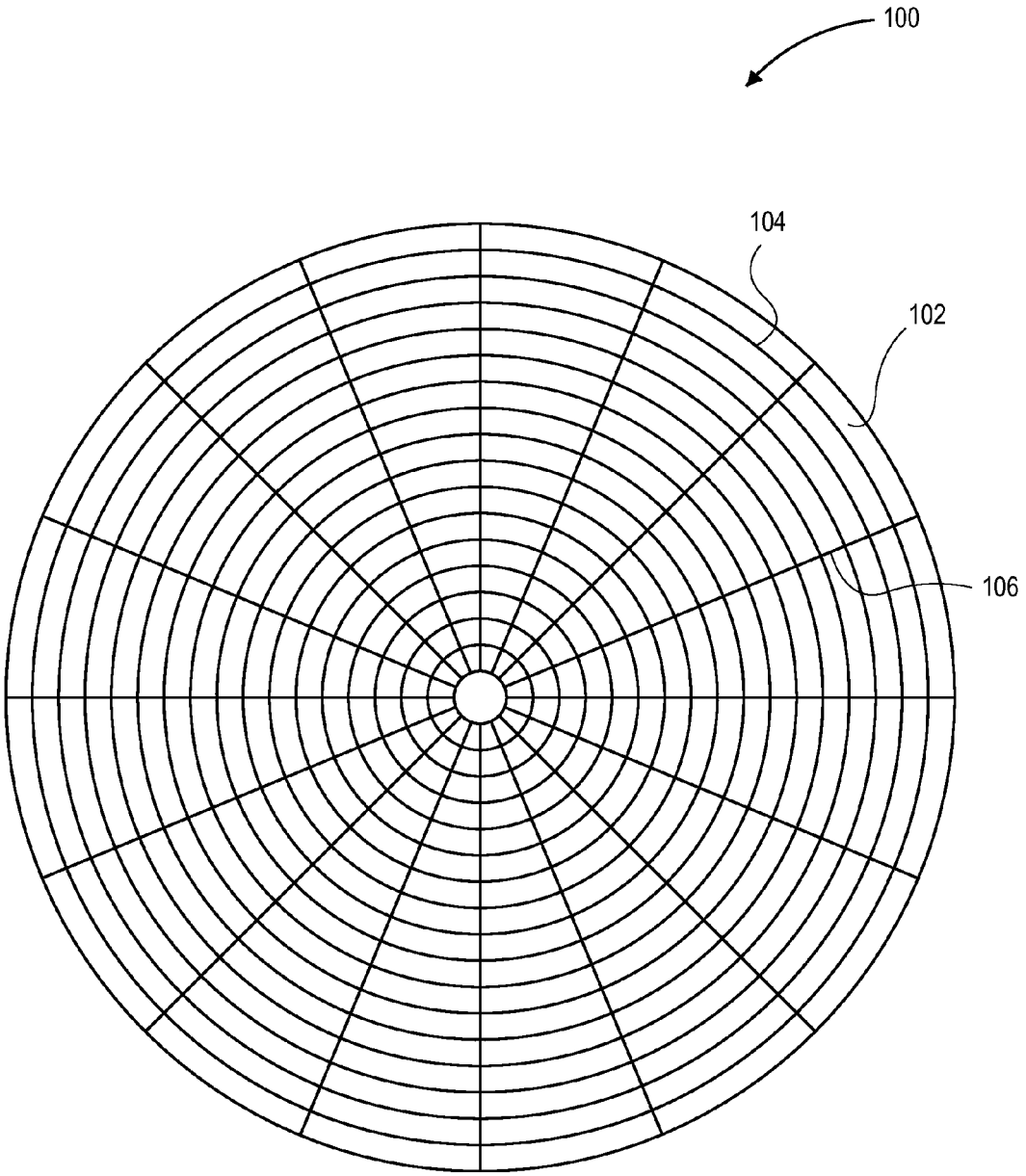
FIG. 1 illustrates a top-down plan view of a concentric circular groove pattern disposed in the polishing surface of a conventional polishing pad.

Polishing pads with concentric or approximately concentric polygon groove patterns are described herein. In the following description, numerous specific details are set forth, such as specific polishing pad compositions and designs, in order to provide a thorough understanding of embodiments of the present invention. It will be apparent to one skilled in the art that embodiments of the present invention may be practiced without these specific details. In other instances, well-known processing techniques, such as details concerning the combination of a slurry with a polishing pad to perform CMP of a semiconductor substrate, are not described in detail in order to not unnecessarily obscure embodiments of the present invention. Furthermore, it is to be understood that the various embodiments shown in the figures are illustrative representations and are not necessarily drawn to scale.

Polishing pads for polishing substrates in CMP operations typically include at least one surface with physical grooves formed therein. The grooves may be arranged to balance an appropriate amount of surface area for polishing the substrate while providing a reservoir for slurry used in the CMP operation. In accordance with embodiment of the present invention, groove patterns based on a series of concentric polygon shapes are described for polishing surfaces of polishing pads. As an example, a polishing pad with a diameter of approximately 20 inches has a polishing surface with a groove pattern based on concentric decagonal grooves.

Groove patterns described herein may provide benefits for, or may be advantageous over prior art polishing pads for, polishing substrates in a CMP operation using slurry. For example, advantages of groove patterns described herein may include (a) improved averaging of a slurry-based polish process across a polished substrate as the polishing pad rotates and the individual grooves translate radially inward and outward, (b) improved slurry retention on the polishing pad relative to pads with radial grooves. Both concepts are described in greater detail below, e.g., in association with FIGS. 5B and 2, respectively.

Basic embodiments of the present invention include groove patterns based on a series of grooves that form similar polygons, all with the same center point, and all aligned with an angle theta of zero so that their straight line segments are parallel and their angles are aligned in a radial fashion. Nested triangles, squares, pentagons, hexagons, etc., are all considered within the spirit and scope of the present invention. There may be a maximum number of straight line segments above which the polygons will become approximately circular. Preferred embodiments may include limiting the groove pattern to polygons with a number of sides less than such a number of straight line segments. One reason for this approach may be to improve averaging of the polish benefit, which might otherwise be diminished as the number of sides of each polygon increases and approaches a circular shape. Another embodiment includes groove patterns with concentric polygons having a center that is not in the same location as the polishing pad center.

More involved embodiments may include groove patterns with concentric polygons oriented to have a small angle, theta, relative to one another. This small angle theta can be positive or negative relative to the direction of rotation of the pad on the polishing tool. Such embodiments may provide a visual impression of the straight line angles forming a gentle spiral from the center to the edge of the polishing pad (see description of FIG. 7A, below). Such a pattern may also provide a varying land width as a polishing land is followed around the polishing pad. There may be further advantages in polish performance and slurry retention stemming from such a skewed groove pattern.

Conventional polishing pads typically have concentric circular groove patterns. For example, FIG. 1 illustrates a top-down plan view of a concentric circular groove pattern disposed in the polishing surface of a conventional polishing pad.

Referring to FIG. 1, a polishing pad 100 includes a polishing body having a polishing surface 102 and a back surface (not shown). The polishing surface 102 has a pattern of grooves of concentric circles 104. The pattern of grooves also includes a plurality of radial grooves 106 continuous from the inner most circle to the outer most circle, as depicted in FIG. 1. The potential drawbacks of such a groove pattern are described throughout with respect to specific embodiments of the present invention.

Polishing pads having radial grooves may exacerbate slurry loss during polishing of a substrate. For example, FIG. 2 illustrates a top-down plan view of a concentric polygon groove pattern, with radial grooves continuous from the inner most polygon to the outer most polygon, disposed in the polishing surface of a conventional polishing pad.

Figure 2:
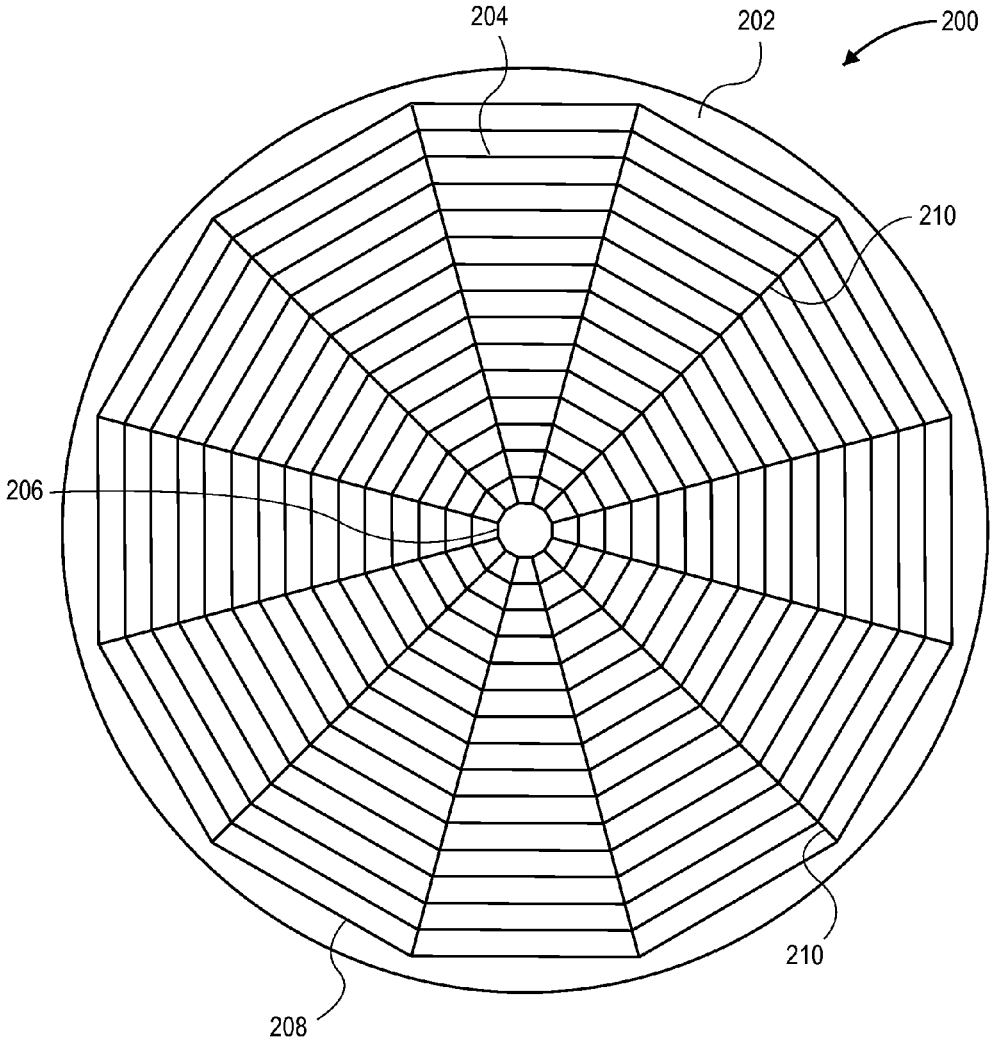
FIG. 2 illustrates a top-down plan view of a concentric polygon groove pattern, with radial grooves continuous from the inner most polygon to the outer most polygon, disposed in the polishing surface of a conventional polishing pad.

Referring to FIG. 2, a polishing pad 200 includes a polishing body having a polishing surface 202 and a back surface (not shown). The polishing surface 202 has a pattern of grooves of concentric polygons. For example, in an embodiment, the pattern of grooves of concentric polygons is a pattern of grooves of concentric dodecagons 204, as depicted in FIG. 2. However, the pattern of grooves also includes a plurality of radial grooves 210 continuous from the inner most polygon 206 to the outer most polygon 208.

In contrast to FIG. 2, and as exemplified in FIG. 3 below, embodiments of the present invention include patterns of concentric polygons without the presence of radial grooves continuous from the inner most polygon to the outer most polygon. By not including such radial grooves, slurry retention on the polishing pad may be improved relative to pads with such radial grooves. For example, such continuous radial grooves can act as drainage channels, effectively draining slurry off of the polishing pad before utilization of that slurry in the polishing process.

In an aspect of the present invention, a polishing pad may be fabricated with a polishing surface having a concentric polygon pattern of grooves thereon. As an example, FIG. 3 illustrates a top-down plan view of a concentric polygon groove pattern, with no radial groove continuous from the inner most polygon to the outer most polygon, disposed in the polishing surface of a polishing pad, in accordance with an embodiment of the present invention.

Figure 3:
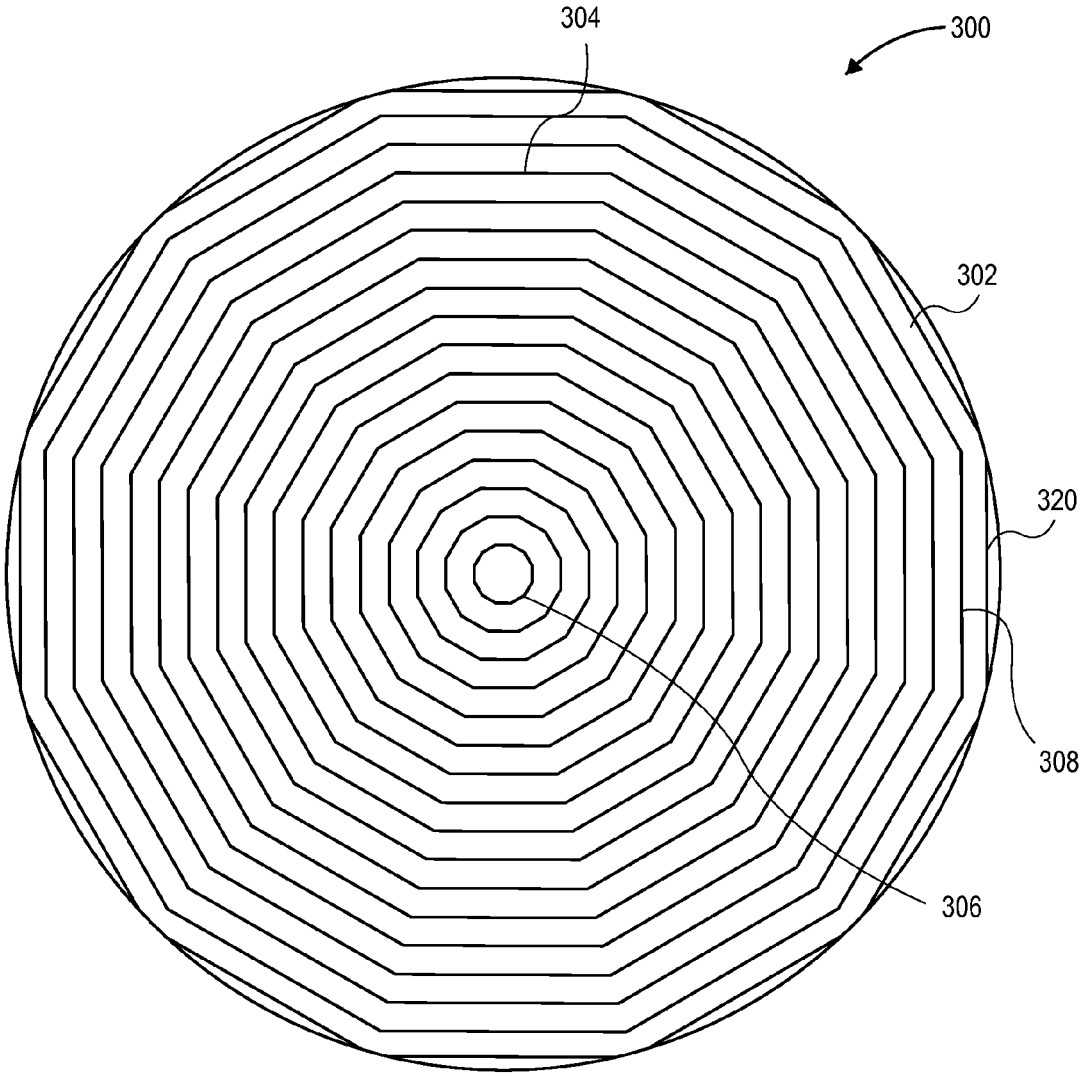
FIG. 3 illustrates a top-down plan view of a concentric polygon groove pattern, with no radial groove continuous from the inner most polygon to the outer most polygon, disposed in the polishing surface of a polishing pad, in accordance with an embodiment of the present invention.

Referring to FIG. 3, a polishing pad 300 includes a polishing body having a polishing surface 302 and a back surface (not shown). The polishing surface 302 has a pattern of grooves of concentric polygons. For example, in an embodiment, the pattern of grooves of concentric polygons is a pattern of grooves of concentric dodecagons 304, as depicted in FIG. 3. In accordance with an embodiment of the present invention, each of the concentric polygons has the same number of edges. For example, in one embodiment, each of the concentric polygons has twelve edges. In contrast to the polishing pad of FIG. 2, the pattern of grooves has no radial groove continuous from the inner most polygon 306 to the outer most polygon 308. As described above, in an embodiment, the absence of a radial groove continuous from the inner most polygon 306 to the outer most polygon 308 aids in retention of slurry on the polishing surface of the polishing pad 300. More particularly, in one embodiment, the pattern of grooves has no radial grooves whatsoever, as depicted in FIG. 3.

It is to be understood that the outer edges of the polishing pad 300 may not be able to accommodate complete polygons. However, there may be a need to include grooves at the outer most reaches of polishing pad 300. For example, in an embodiment, one or more broken polygons 320 is included near or at the edge of polishing pad 300, as is depicted in FIG. 3.

In another aspect of the present invention, a polishing pad may be fabricated with a polishing surface having thereon a concentric polygon pattern of grooves and one or more radial groove that is not continuous from the inner most polygon to the outer most polygon of the concentric. Inclusion of such a radial groove may be included as a marking to indicate a feature of the polishing pad or may be included for very localized slurry transfer. Also, such a radial groove may be present as an artifact of a pad fabrication process.

Figures 4A, 4B, 4C:
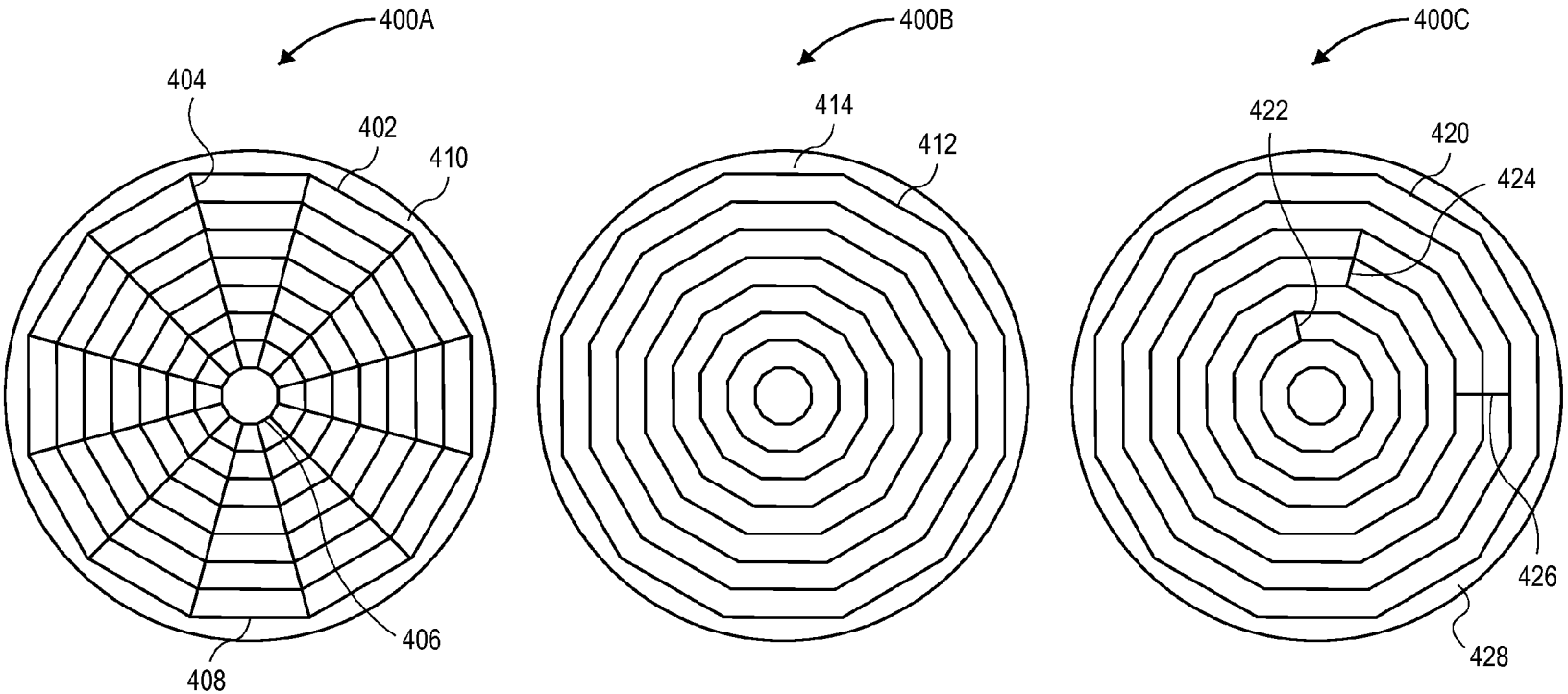
FIG. 4A illustrates a top-down plan view of a concentric polygon groove pattern, with radial grooves continuous from the inner most polygon to the outer most polygon, disposed in the polishing surface of a conventional polishing pad.
FIG. 4B illustrates a top-down plan view of a concentric polygon groove pattern, with no radial groove continuous from the inner most polygon to the outer most polygon, disposed in the polishing surface of a polishing pad, in accordance with an embodiment of the present invention.
FIG. 4C illustrates a top-down plan view of a concentric polygon groove pattern, with a radial groove between successive polygons, disposed in the polishing surface of a polishing pad, in accordance with an embodiment of the present invention.

For comparison, FIG. 4A illustrates a top-down plan view of a concentric polygon groove pattern 402, with radial grooves 404 continuous from the inner most polygon 406 to the outer most polygon 408, disposed in the polishing surface 410 of a conventional polishing pad 400A. Such a pad was described in detail in association with FIG. 2. Also by contrast, FIG. 4B illustrates a top-down plan view of a concentric polygon groove pattern 412, with no radial grooves, disposed in the polishing surface 414 of a polishing pad 400B, in accordance with an embodiment of the present invention. Such a pad was described in detail in association with FIG. 3.

Instead, FIG. 4C illustrates a top-down plan view of a concentric polygon groove pattern 420, with one or more radial grooves 422, 424, 426 between successive polygons, disposed in the polishing surface 428 of a polishing pad 400C, in accordance with an embodiment of the present invention. Thus, in an embodiment, the pattern of grooves further includes a radial groove between two successive polygons of the concentric polygons. In one embodiment, the radial groove extends between only two immediately successive polygons, such as radial groove 422. In another embodiment, the radial groove extends beyond two immediately successive polygons, such as radial groove 422. In another embodiment, in contrast to radial grooves 422 and 424, the radial groove is positioned at the sides of the polygons as opposed to the corners, such as radial groove 426.

Figure 5B:
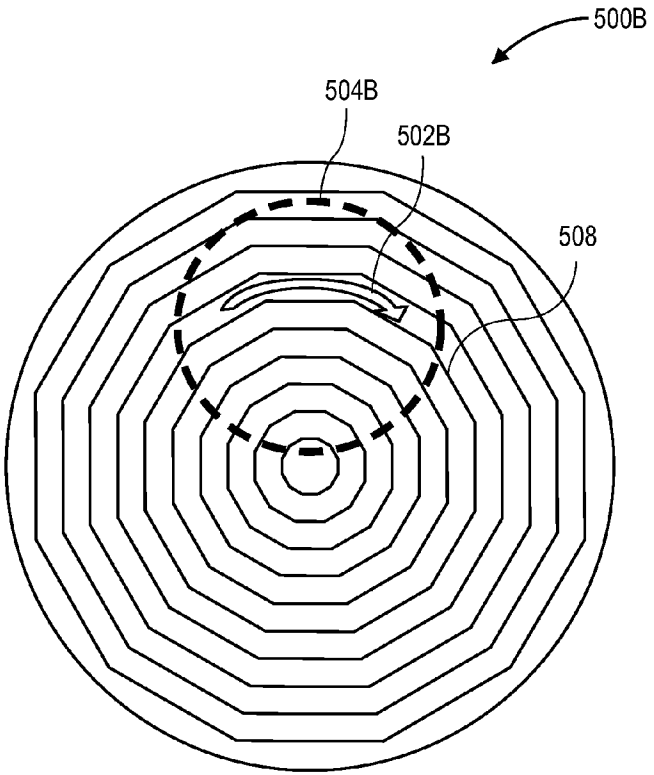
FIG. 5B illustrates a top-down plan view of the trajectory for a polygon groove of a concentric polygon groove pattern disposed in the polishing surface of a polishing pad, in accordance with an embodiment of the present invention.
Figure 5A:
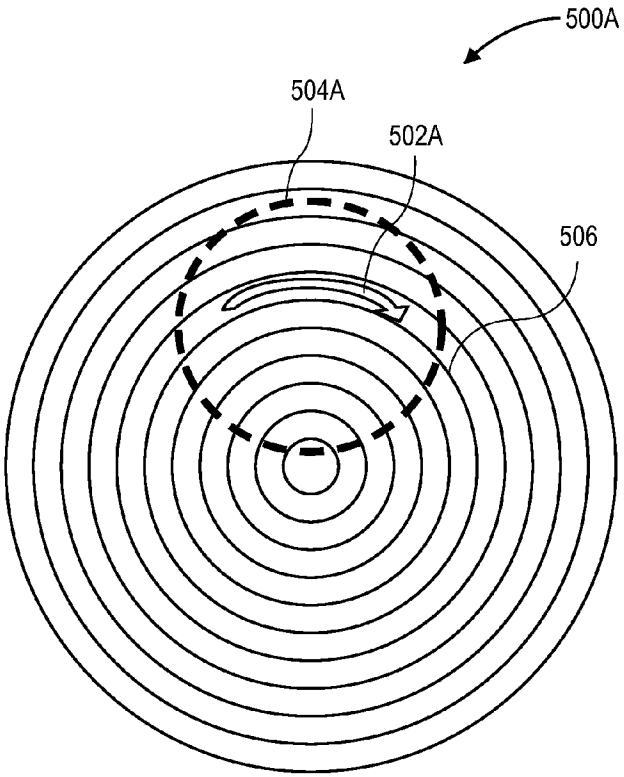
FIG. 5A illustrates a top-down plan view of the trajectory for a circular groove of a concentric circular groove pattern disposed in the polishing surface of a conventional polishing pad.

By including a pattern of concentric polygon grooves, versus concentric circles, improved averaging of a polish process may be achieved across a polished substrate as the polishing pad rotates and the individual grooves translate radially inward and outward. As an example, FIG. 5A illustrates a top-down plan view of the trajectory for a circular groove of a concentric circular groove pattern disposed in the polishing surface of a conventional polishing pad. FIG. 5B illustrates a top-down plan view of the trajectory for a polygon groove of a concentric polygon groove pattern disposed in the polishing surface of a polishing pad, in accordance with an embodiment of the present invention.

Referring to FIG. 5A, a trajectory 502A across a polished substrate 504A as a polishing pad 500A rotates along a circular groove 506 of a concentric circular groove pattern disposed in the polishing surface of a conventional polishing pad. The trajectory 502A remains fixed on the circular groove 506, restricting the amount of surface of substrate 504A subjected to the polishing process from circular groove 506. By contrast, a trajectory 502B across a polished substrate 504B as a polishing pad 500B rotates along a polygon groove 508 of a concentric polygon groove pattern disposed in the polishing surface of polishing pad. The trajectory 502B translates radially inward and outward for polygon groove 508, increasing the amount of surface of substrate 504B subjected to the polishing process from polygon groove 506.

Figure 6B:
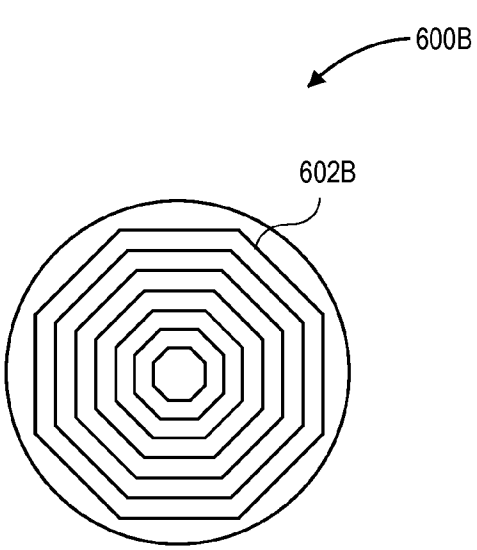
FIG. 6B illustrates a top-down plan view of a concentric octagon groove pattern disposed in the polishing surface of a polishing pad, in accordance with an embodiment of the present invention.
Figure 6A:
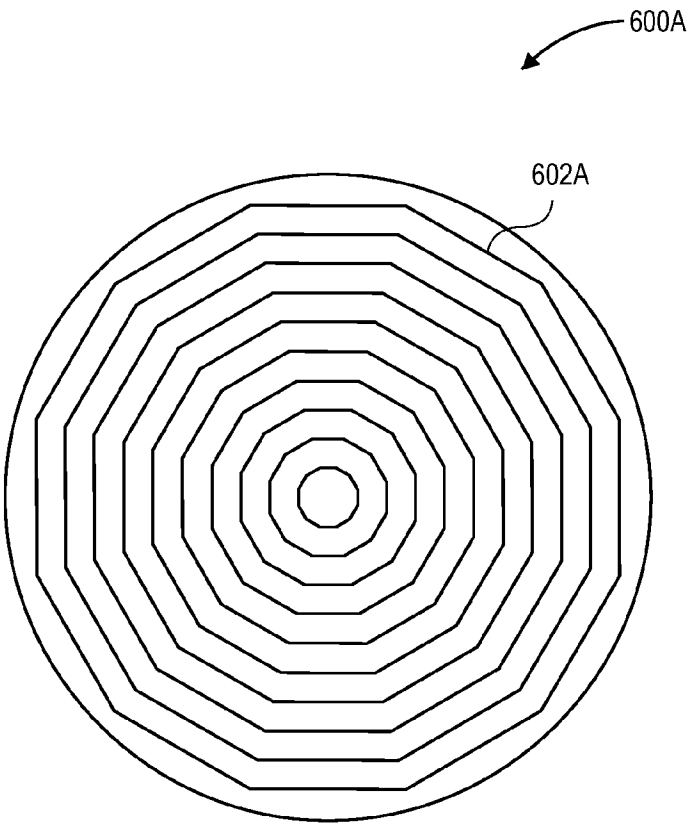
FIG. 6A illustrates a top-down plan view of a concentric dodecagon groove pattern disposed in the polishing surface of a polishing pad, in accordance with an embodiment of the present invention.

In another aspect of the present invention, the number of faces of each polygon in a concentric pattern of polygons may be varied depending on the specific application, as well as the size, of the polishing pad. As an example, FIG. 6A illustrates a top-down plan view of a concentric dodecagon groove pattern 602A disposed in the polishing surface of a polishing pad 600A, in accordance with an embodiment of the present invention. FIG. 6B illustrates a top-down plan view of a concentric octagon groove pattern 602B disposed in the polishing surface of a polishing pad 600B, in accordance with an embodiment of the present invention.

In an embodiment, the number of edges of each polygon is determined by the diameter of the polishing pad or by the diameter of the substrate to be polished by the polishing pad. For example, in one embodiment, the diameter of the polishing pad is approximately 30 inches, the diameter of the substrate is approximately 12 inches, and the concentric polygons are concentric hexadecagons. In another embodiment, the diameter of the polishing pad is approximately 20 inches, the diameter of the substrate is approximately 8 inches, and the concentric polygons are concentric decagons. In an embodiment, the length of each edge of the outer most polygon is approximately in the range of 50-60% of the length of the diameter of the substrate to be polished. In another embodiment, a polishing pad contemplated herein is used to polish a substrate having a diameter of approximately 450 millimeters.

Figure 7B:
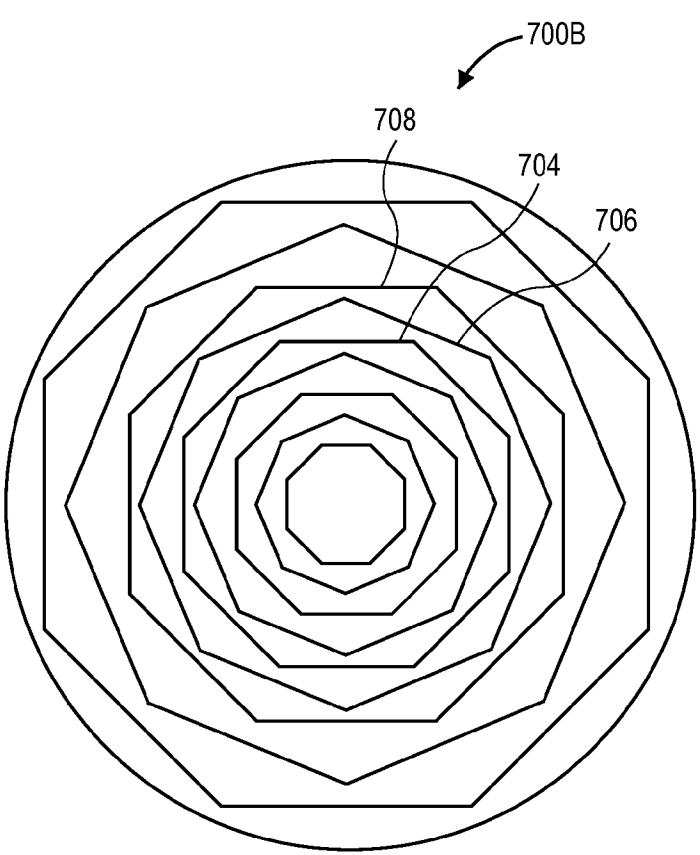
FIG. 7B illustrates a top-down plan view of a concentric polygon groove pattern, with alternating rotated successive polygons, disposed in the polishing surface of a polishing pad, in accordance with an embodiment of the present invention.
Figure 7A:
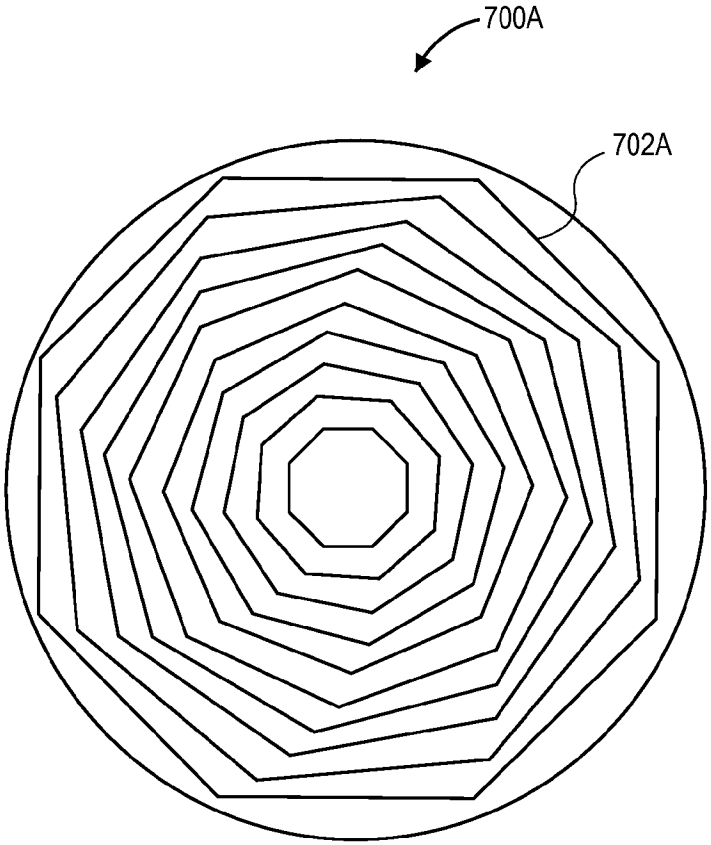
FIG. 7A illustrates a top-down plan view of a concentric polygon groove pattern, with rotated successive polygons, disposed in the polishing surface of a polishing pad, in accordance with an embodiment of the present invention.

A plurality of concentric polygons, if not offset from one another, may induce a rain gutter effect by inadvertently removing large amounts of slurry at locations where the edges of the polygons are aligned. Instead, in another aspect of the present invention, successive polygons may be rotated relative to one another. For example, FIG. 7A illustrates a top-down plan view of a concentric polygon groove pattern, with rotated successive polygons, disposed in the polishing surface of a polishing pad, in accordance with an embodiment of the present invention. FIG. 7B illustrates a top-down plan view of a concentric polygon groove pattern, with alternating rotated successive polygons, disposed in the polishing surface of a polishing pad, in accordance with an embodiment of the present invention.

As a comparison to illustrate the above concept, referring again to FIG. 3, in an embodiment, each polygon of the concentric polygons has no degree of rotation relative to its successive polygon. However, referring to FIG. 7A, a polishing pad 700A has a concentric polygon groove pattern with rotated successive polygons 702A. That is, in an embodiment, one or more of the polygons 702A of the concentric polygons has a degree of rotation relative to its successive polygon. In one embodiment, the one or more polygons has a clockwise rotation relative to the successive polygon, as depicted in FIG. 7A. In an alternative embodiment, the one or more polygons have a counter-clockwise rotation relative to the successive polygon. Referring to FIG. 7B, in another aspect, the rotation is staggered such that a polygon 704 is rotated relative to it immediately successive polygon 706, but has no degree of rotation relative to its next successive polygon 708. In an embodiment, the degree of rotation is determined by the total number of concentric polygons in the pattern of grooves. In one embodiment, the degree of rotation is selected such that inner most polygon is progressively skewed through to the outer most polygon by one turn of a face of the selected polygon shape. For example, in a very specific embodiment, a 30 inch polishing pad includes 100 concentric decagons. Each successive decagon is rotated in the same direction by 0.36 degrees relative to its predecessor decagon.

Figure 8:
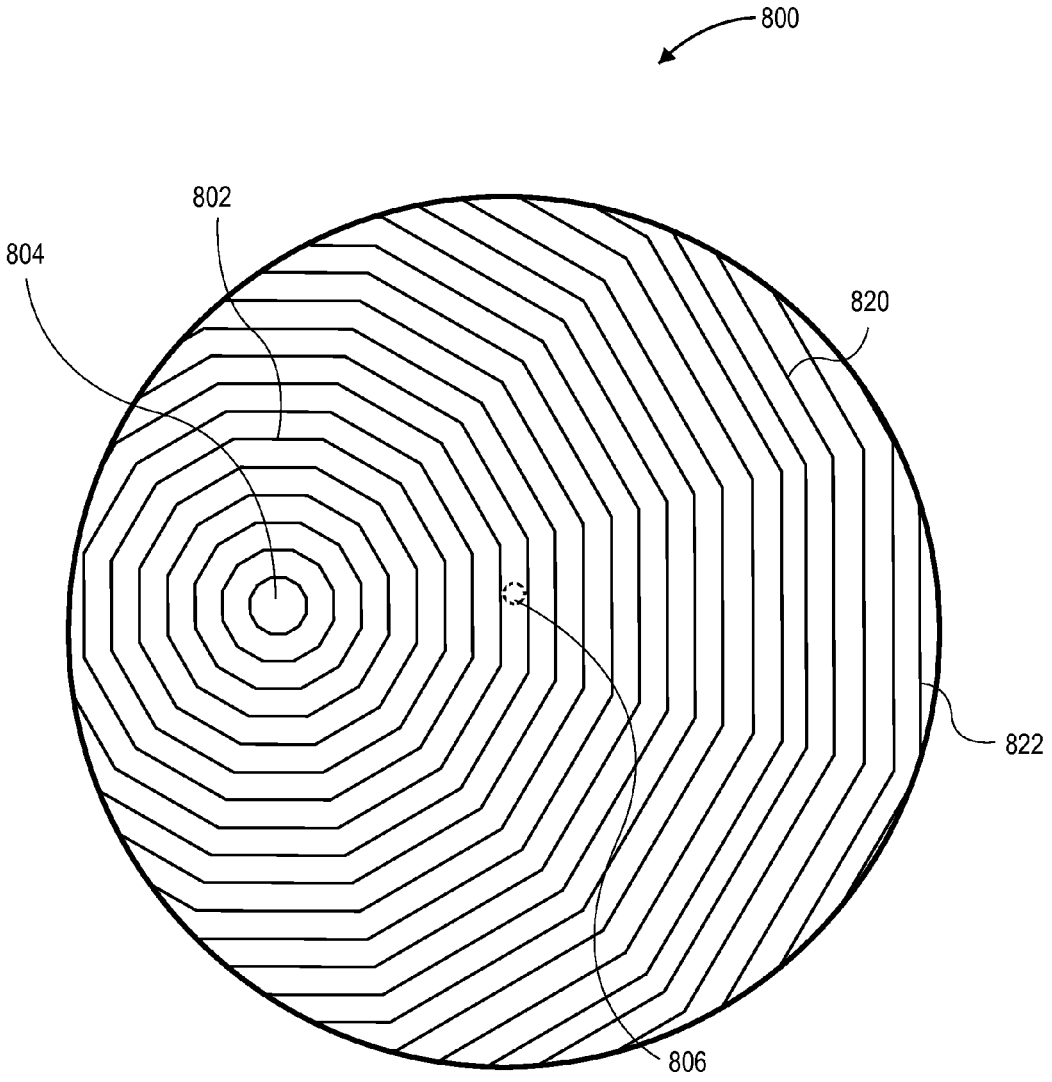
FIG. 8 illustrates a top-down plan view of a concentric polygon groove pattern, with an offset center, disposed in the polishing surface of a polishing pad, in accordance with an embodiment of the present invention.

In another aspect, the center of the concentric polygons of a groove pattern need not be at the center of a polishing pad. For example, FIG. 8 illustrates a top-down plan view of a concentric polygon groove pattern, with an offset center, disposed in the polishing surface of a polishing pad, in accordance with an embodiment of the present invention.

As a comparison to illustrate the above concept, referring again to FIG. 3, in an embodiment, the center of the concentric polygons is located at the center of the polishing pad. However, referring to FIG. 8, a concentric polygon groove pattern 802 is disposed in the polishing surface of a polishing pad 800. The center 804 of the concentric polygons is offset from the center 806 of the polishing pad 800. Such an arrangement may be practical for some specific substrate designs or polish processes.

It is to be understood that the outer edges of the polishing pad 800 may not be able to accommodate complete polygons. However, there may be a need to include grooves at the outer most reaches of polishing pad 800. For example, in an embodiment, one or more partial polygons 820 and/or one or more broken polygons 822 is included near or at the edge of polishing pad 800, as is depicted in FIG. 8.

In another aspect, the concentric polygon pattern may be interrupted with non-polygon grooves. For example, FIG. 9A illustrates a top-down plan view of a concentric polygon groove pattern, with interrupting non-polygonal grooves, disposed in the polishing surface of a polishing pad, in accordance with an embodiment of the present invention.

Figure 9B:
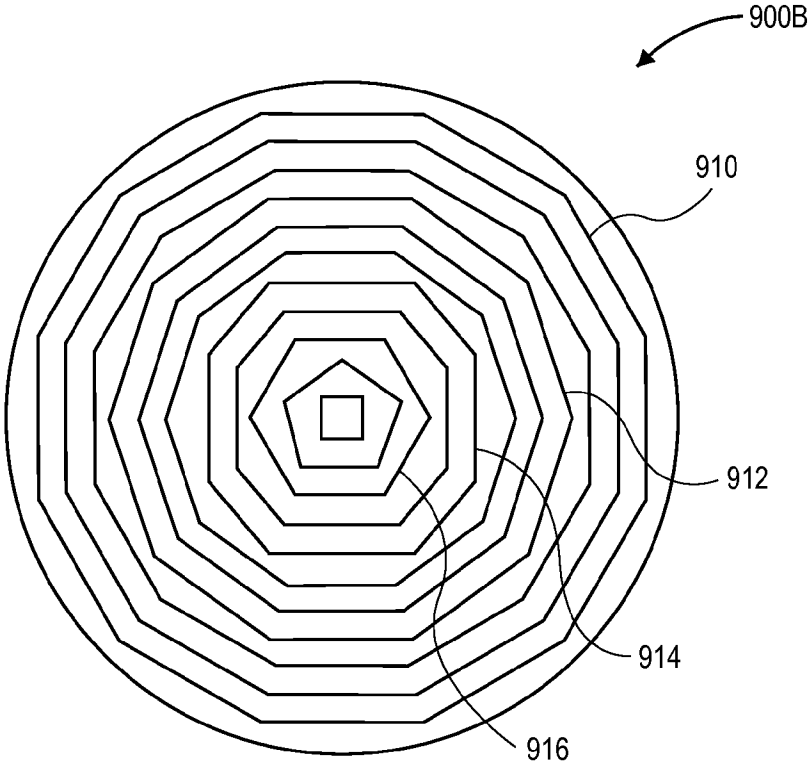
FIG. 9B illustrates a top-down plan view of a concentric polygon groove pattern, where one of the polygons has a different number of edges than another of the polygons, disposed in the polishing surface of a polishing pad, in accordance with an embodiment of the present invention.
Figure 9A:
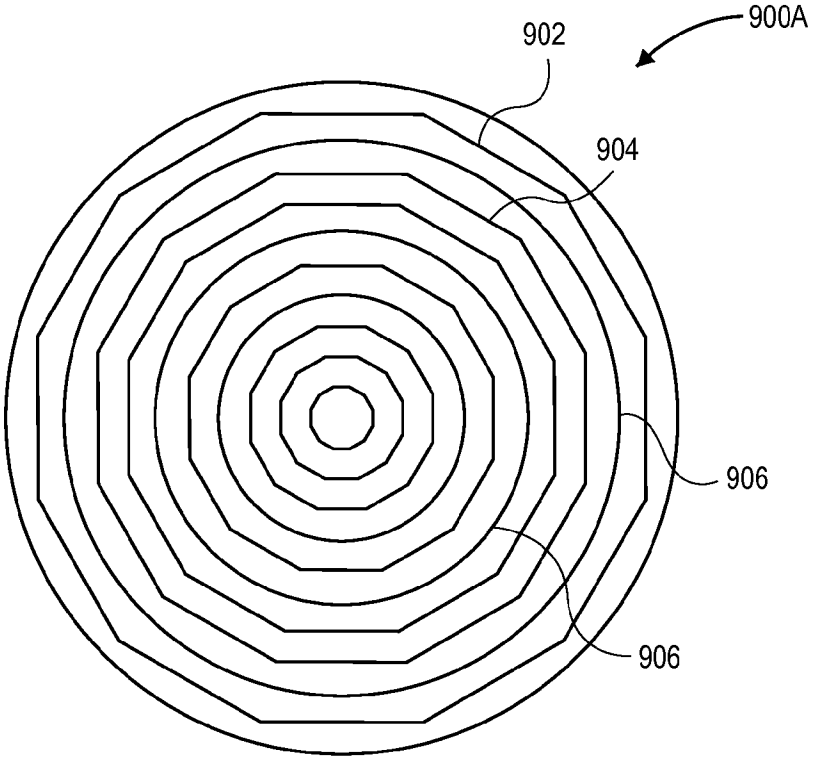
FIG. 9A illustrates a top-down plan view of a concentric polygon groove pattern, with interrupting non-polygonal grooves, disposed in the polishing surface of a polishing pad, in accordance with an embodiment of the present invention.

Referring to FIG. 9A, a polishing pad 900A has a pattern of grooves of concentric polygons 902. One or more non-polygonal grooves 906 interrupt the pattern of concentric polygons 902. For example, concentric polygons 902 and 904 are separated by a non-polygonal groove 906. In an embodiment, the center of each non-polygonal groove 906 is located at the center of the concentric polygons 902, as depicted in FIG. 9A. In an embodiment, the non-polygonal grooves are circular, as is also depicted in FIG. 9A.

In another aspect, the concentric polygon pattern need not include polygons all having the same number of edges. For example, FIG. 9B illustrates a top-down plan view of a concentric polygon groove pattern, where one of the polygons has a different number of edges than another of the polygons, disposed in the polishing surface of a polishing pad, in accordance with an embodiment of the present invention.

Referring to FIG. 9B, a polishing pad 900B has a pattern of grooves of concentric polygons 910. One of the concentric polygons has a different number of edges than another of the concentric polygons. For example, polygon 910 has twelve edges, polygon 912 has ten edges, polygon 914 has eight edges, and polygon 916 has six edges. In an embodiment, the outer most polygon has more edges than the inner most polygon, as depicted in FIG. 9B. This arrangement may enable retention of longer edge lengths that would be achievable if the same number of edges was used for each polygon upon approaching the center of the polishing pad. By retaining longer edge lengths upon approaching the center of the polishing pad, a more even polishing process may be achieved as a polished substrate changes location around the polishing pad.

In an embodiment, polishing pads described herein, such as polishing pad 300, 400B, 400C, 500B, 600A, 600B, 700A, 700B, 800, 900A or 900B, are suitable for polishing substrates. The substrate may be one used in the semiconductor manufacturing industry, such as a silicon substrate having device or other layers disposed thereon. However, the substrate may be one such as, but not limited to, a substrates for MEMS devices, reticles, or solar modules. Thus, reference to "a polishing pad for polishing a substrate," as used herein, is intended to encompass these and related possibilities.

Polishing pads described herein, such as polishing pad 300, 400B, 400C, 500B, 600A, 600B, 700A, 700B, 800, 900A or 900B, may be composed of a homogeneous polishing body of a thermoset polyurethane material. In an embodiment, the homogeneous polishing body is composed of a thermoset, closed cell polyurethane material. In an embodiment, the term "homogeneous" is used to indicate that the composition of a thermoset, closed cell polyurethane material is consistent throughout the entire composition of the polishing body. For example, in an embodiment, the term "homogeneous" excludes polishing pads composed of, e.g., impregnated felt or a composition (composite) of multiple layers of differing material. In an embodiment, the term "thermoset" is used to indicate a polymer material that irreversibly cures, e.g., the precursor to the material changes irreversibly into an infusible, insoluble polymer network by curing. For example, in an embodiment, the term "thermoset" excludes polishing pads composed of, e.g., "thermoplast" materials or "thermoplastics"—those materials composed of a polymer that turns to a liquid when heated and returns to a very glassy state when cooled sufficiently. It is noted that polishing pads made from thermoset materials are typically fabricated from lower molecular weight precursors reacting to form a polymer in a chemical reaction, while pads made from thermoplastic materials are typically fabricated by heating a pre-existing polymer to cause a phase change so that a polishing pad is formed in a physical process. Polyurethane thermoset polymers may be selected for fabricating polishing pads described herein based on their stable thermal and mechanical properties, resistance to the chemical environment, and tendency for wear resistance.

In an embodiment, polishing pads described herein, such as polishing pad 300, 400B, 400C, 500B, 600A, 600B, 700A, 700B, 800, 900A or 900B, include a molded homogeneous polishing body. The term "molded" is used to indicate that a homogeneous polishing body is formed in a formation mold, as described in more detail below in association with FIGS. 11A-11F. In an embodiment, the homogeneous polishing body, upon conditioning and/or polishing, has a polishing surface roughness approximately in the range of 1-5 microns root mean square. In one embodiment, the homogeneous polishing body, upon conditioning and/or polishing, has a polishing surface roughness of approximately 2.35 microns root mean square. In an embodiment, the homogeneous polishing body has a storage modulus at 25 degrees Celsius approximately in the range of 30-120 megaPascals (MPa). In another embodiment, the homogeneous polishing body has a storage modulus at 25 degrees Celsius approximately less than 30 megaPascals (MPa).

In an embodiment, polishing pads described herein, such as polishing pad 300, 400B, 400C, 500B, 600A, 600B, 700A, 700B, 800, 900A or 900B, include a polishing body having a plurality of closed cell pores therein. In one embodiment, the plurality of closed cell pores is a plurality of porogens. For example, the term "porogen" may be used to indicate micro- or nano-scale spherical or somewhat spherical particles with "hollow" centers. The hollow centers are not filled with solid material, but may rather include a gaseous or liquid core. In one embodiment, the plurality of closed cell pores is composed of pre-expanded and gas-filled EXPANCEL™ distributed throughout (e.g., as an additional component in) a homogeneous polishing body of the polishing pad. In a specific embodiment, the EXPANCEL™ is filled with pentane. In an embodiment, each of the plurality of closed cell pores has a diameter approximately in the range of 10-100 microns. In an embodiment, the plurality of closed cell pores includes pores that are discrete from one another. This is in contrast to open cell pores which may be connected to one another through tunnels, such as the case for the pores in a common sponge. In one embodiment, each of the closed cell pores includes a physical shell, such as a shell of a porogen, as described above. In another embodiment, however, each of the closed cell pores does not include a physical shell. In an embodiment, the plurality of closed cell pores is distributed essentially evenly throughout a thermoset polyurethane material of a homogeneous polishing body.

In an embodiment, the homogeneous polishing body is opaque. In one embodiment, the term "opaque" is used to indicate a material that allows approximately 10% or less visible light to pass. In one embodiment, the homogeneous polishing body is opaque in most part, or due entirely to, the inclusion of an opacifying lubricant throughout (e.g., as an additional component in) the homogeneous thermoset, closed cell polyurethane material of the homogeneous polishing body. In a specific embodiment, the opacifying lubricant is a material such as, but not limited to: boron nitride, cerium fluoride, graphite, graphite fluoride, molybdenum sulfide, niobium sulfide, talc, tantalum sulfide, tungsten disulfide, or Teflon.

The sizing of the homogeneous polishing body may be varied according to application. Nonetheless, certain parameters may be used to make polishing pads including such a homogeneous polishing body compatible with conventional processing equipment or even with conventional chemical mechanical processing operations. For example, in accordance with an embodiment of the present invention, the homogeneous polishing body has a thickness approximately in the range of 0.075 inches to 0.130 inches, e.g., approximately in the range of 1.9-3.3 millimeters. In one embodiment, the homogeneous polishing body has a diameter approximately in the range of 20 inches to 30.3 inches, e.g., approximately in the range of 50-77 centimeters, and possibly approximately in the range of 10 inches to 42 inches, e.g., approximately in the range of 25-107 centimeters. In one embodiment, the homogeneous polishing body has a pore density approximately in the range of 6%-36% total void volume, and possibly approximately in the range of 15%-35% total void volume. In one embodiment, the homogeneous polishing has a porosity of the closed cell type, as described above, due to inclusion of a plurality of pores. In one embodiment, the homogeneous polishing body has a compressibility of approximately 2.5%. In one embodiment, the homogeneous polishing body has a density approximately in the range of 0.70-1.05 grams per cubic centimeter.

Figure 10:
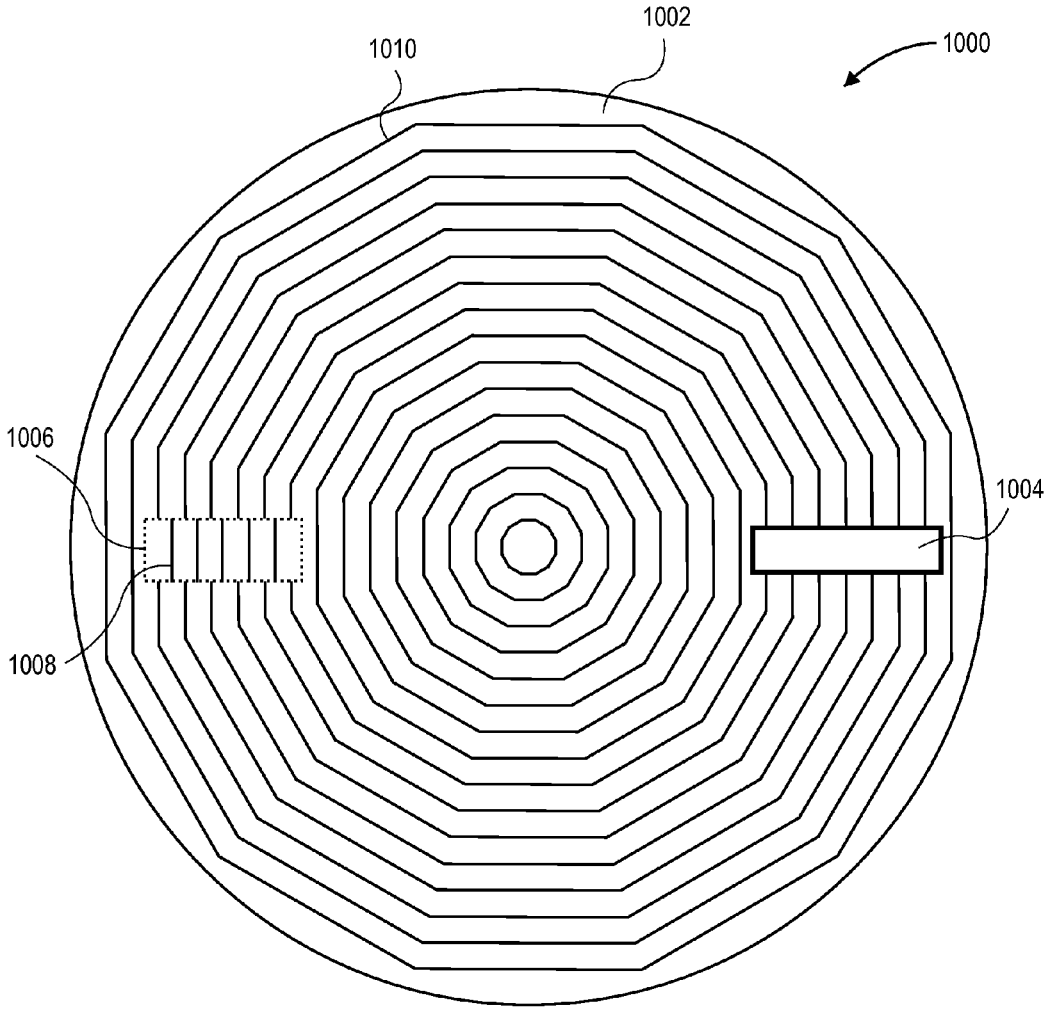
FIG. 10 illustrates a top-down plan view of a concentric polygon groove pattern, the pattern interrupted by a local area transparency (LAT) region and/or an indication region, disposed in the polishing surface of a polishing pad, in accordance with an embodiment of the present invention.

In another embodiment of the present invention, a polishing pad with a polishing surface having a concentric polygon pattern of grooves thereon further includes a local area transparency (LAT) region disposed in the polishing pad. For example, FIG. 10 illustrates a top-down plan view of a concentric polygon groove pattern, the pattern interrupted by a local area transparency (LAT) region and/or an indication region, disposed in the polishing surface 1002 of a polishing pad 1000, in accordance with an embodiment of the present invention. Specifically, a LAT region 1004 is disposed in the polishing body of polishing pad 1000. As depicted in FIG. 10, the LAT region 1004 interrupts a pattern of grooves of concentric polygons 1010. In an embodiment, the LAT region 1004 is disposed in, and covalently bonded with, a homogeneous polishing body of the polishing pad 1000. Examples of suitable LAT regions are described in U.S. patent application Ser. No. 12/895,465 filed on Sep. 30, 2010, assigned to NexPlanar Corporation.

In another embodiment, a polishing pad with a polishing surface having a concentric polygon pattern of grooves thereon further includes a detection region for use with, e.g., an eddy current detection system. For example, referring again to FIG. 10, the polishing surface 1002 of polishing pad 1000 includes an indication region 1006 indicating the location of a detection region disposed in the back surface of the polishing pad 1000. In one embodiment, the indication region 1006 interrupts pattern of grooves of concentric polygons 1010 with a second pattern of grooves 1008, as depicted in FIG. 10. Examples of suitable eddy current detection regions are described in U.S. patent application Ser. No. 12/895,465 filed on Sep. 30, 2010, assigned to NexPlanar Corporation.

In another aspect of the present invention, polishing pads with concentric polygon groove patterns may be fabricated in a molding process. For example, FIGS. 11A-11F illustrate cross-sectional views of operations used in the fabrication of a polishing pad, in accordance with an embodiment of the present invention.

Figure 11A:
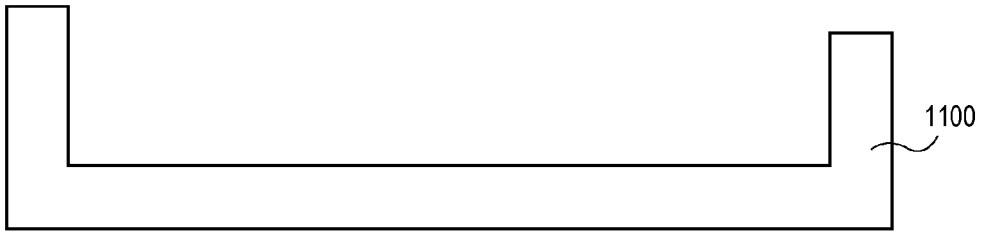
FIGS. 11A-11F illustrate cross-sectional views of operations used in the fabrication of a polishing pad, in accordance with an embodiment of the present invention.
Figure 11B:
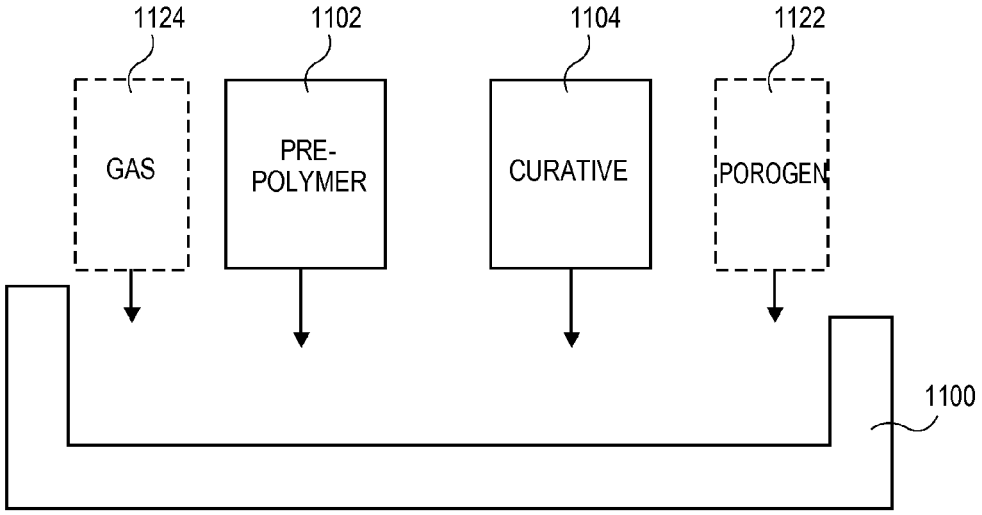
Figure 11C:
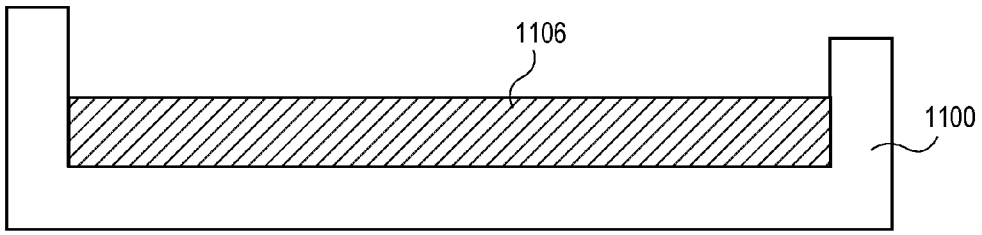

Referring to FIG. 11A, a formation mold 1100 is provided. Referring to FIG. 11B, a pre-polymer 1102 and a curative 1104 are mixed to form a mixture 1106 in the formation mold 1100, as depicted in FIG. 11C. In an embodiment, mixing the pre-polymer 1102 and the curative 1104 includes mixing an isocyanate and an aromatic diamine compound, respectively. In one embodiment, the mixing further includes adding an opacifying lubricant to the pre-polymer 1102 and the curative 1104 to ultimately provide an opaque molded homogeneous polishing body. In a specific embodiment, the opacifying lubricant is a material such as, but not limited to: boron nitride, cerium fluoride, graphite, graphite fluoride, molybdenum sulfide, niobium sulfide, talc, tantalum sulfide, tungsten disulfide, or Teflon.

In an embodiment, the polishing pad precursor mixture 1106 is used to ultimately form a molded homogeneous polishing body composed of a thermoset, closed cell polyurethane material. In one embodiment, the polishing pad precursor mixture 1106 is used to ultimately form a hard pad and only a single type of curative is used. In another embodiment, the polishing pad precursor mixture 1106 is used to ultimately form a soft pad and a combination of a primary and a secondary curative is used. For example, in a specific embodiment, the pre-polymer includes a polyurethane precursor, the primary curative includes an aromatic diamine compound, and the secondary curative includes a compound having an ether linkage. In a particular embodiment, the polyurethane precursor is an isocyanate, the primary curative is an aromatic diamine, and the secondary curative is a curative such as, but not limited to, polytetramethylene glycol, amino-functionalized glycol, or amino-functionalized polyoxypropylene. In an embodiment, the pre-polymer, a primary curative, and a secondary curative have an approximate molar ratio of 100 parts pre-polymer, 85 parts primary curative, and 15 parts secondary curative. It is to be understood that variations of the ratio may be used to provide polishing pads with varying hardness values, or based on the specific nature of the pre-polymer and the first and second curatives.

Figure 11D:
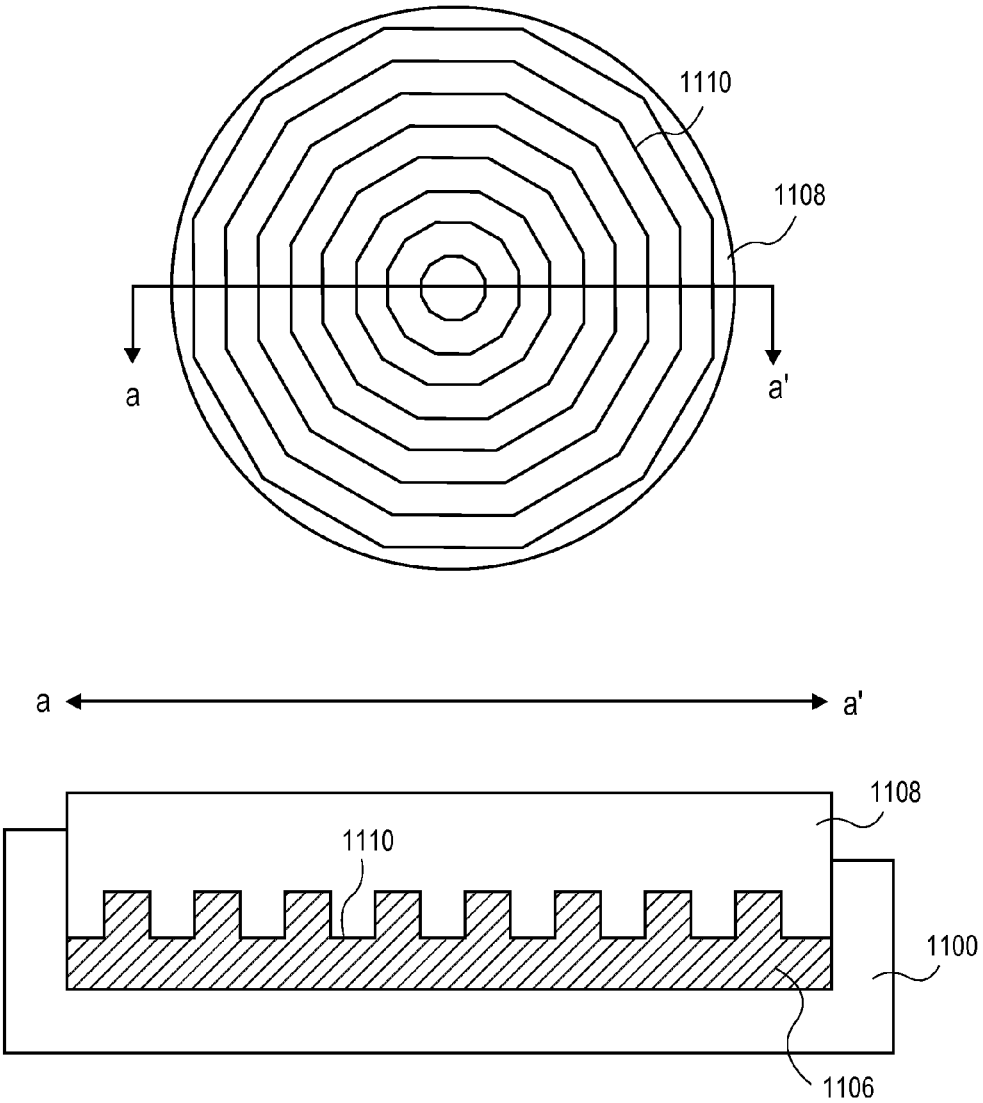

Referring to FIG. 11D, a lid 1108 of the formation mold 1100 is lowered into the mixture 1106. A top-down plan view of lid 1108 is shown on top, while a cross-section along the a-a' axis is shown below in FIG. 11D. In an embodiment, the lid 1108 has disposed thereon a pattern of protrusions 1110 including concentric polygons. The pattern of protrusions 1110 has no radial protrusion continuous from the inner most polygon to the outer most polygon. The pattern of protrusions 1110 is used to stamp a pattern of grooves into a polishing surface of a polishing pad formed in formation mold 1100. In a specific embodiment, the pattern of protrusions 1110 has no radial protrusions.

It is to be understood that embodiments described herein that describe lowering the lid 1108 of a formation mold 1100 need only achieve a bringing together of the lid 1108 and a base of the formation mold 1100. That is, in some embodiments, a base of a formation mold 1100 is raised toward a lid 1108 of a formation mold, while in other embodiments a lid 1108 of a formation mold 1100 is lowered toward a base of the formation mold 1100 at the same time as the base is raised toward the lid 1108.

Figure 11E:
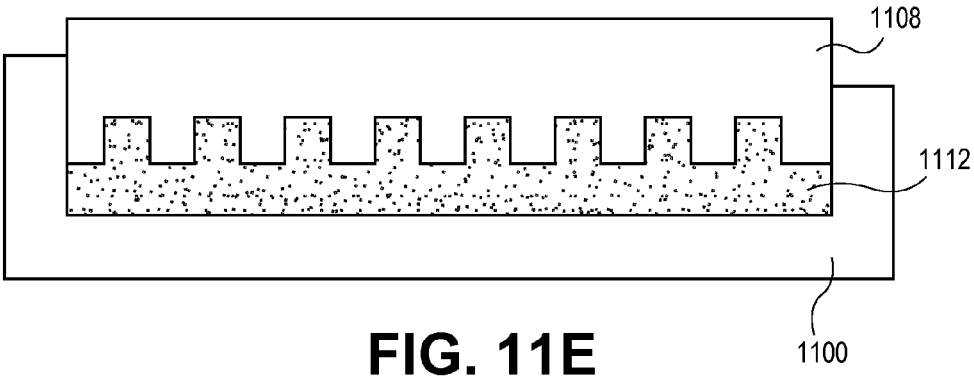

Referring to FIG. 11E, the mixture 1106 is cured to provide a molded homogeneous polishing body 1112 in the formation mold 1100. The mixture 1106 is heated under pressure (e.g., with the lid 1108 in place) to provide the molded homogeneous polishing body 1112. In an embodiment, heating in the formation mold 1100 includes at least partially curing in the presence of lid 1108, which encloses mixture 1106 in formation mold 1100, at a temperature approximately in the range of 200-260 degrees Fahrenheit and a pressure approximately in the range of 2-12 pounds per square inch.

Figure 11F:
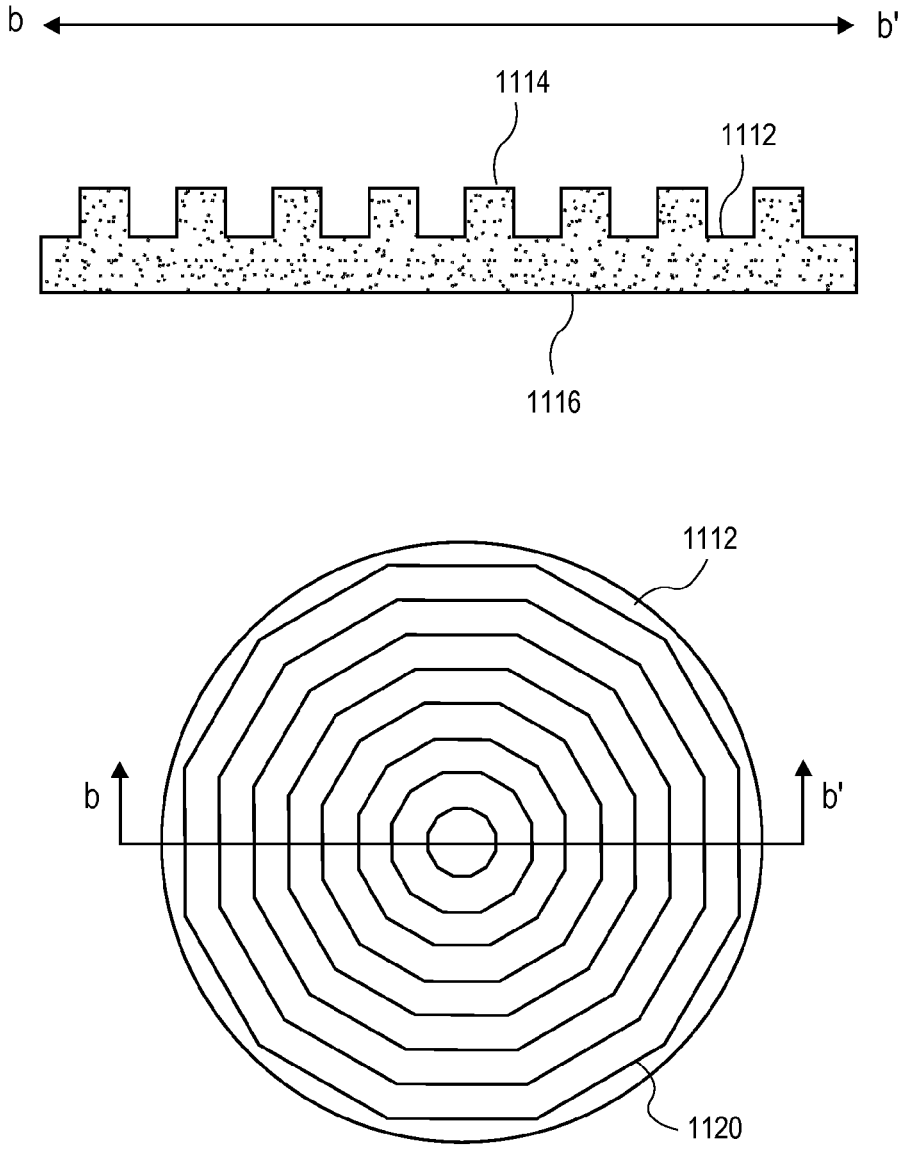

Referring to FIG. 11F, a polishing pad (or polishing pad precursor, if further curing is required) is separated from lid 1108 and removed from formation mold 1100 to provide the discrete molded homogeneous polishing body 1112. A top-down plan view of molded homogeneous polishing body 1112 is shown below, while a cross-section along the b-b' axis is shown above in FIG. 11F. It is noted that further curing through heating may be desirable and may be performed by placing the polishing pad in an oven and heating. Thus, in one embodiment, curing the mixture 1106 includes first partially curing in the formation mold 1100 and then further curing in an oven. Either way, a polishing pad is ultimately provided, wherein a molded homogeneous polishing body 1112 of the polishing pad has a polishing surface 1114 and a back surface 1116. In an embodiment, the molded homogeneous polishing body 1112 is composed of a thermoset polyurethane material and a plurality of closed cell pores disposed in the thermoset polyurethane material. The molded homogeneous polishing body 1112 includes a polishing surface 1114 having disposed therein a pattern of grooves 1120 corresponding to the pattern of protrusions 1110 of the lid 1108. The pattern of grooves 1120 may be a pattern of grooves as described above, e.g., with respect to FIGS. 3, 4B, 4C, 5B, 6A, 6B, 7A, 7B, 8, 9A and 9B.

In an embodiment, referring again to FIG. 11B, the mixing further includes adding a plurality of porogens 1122 to the pre-polymer 1102 and the curative 1104 to provide closed cell pores in the ultimately formed polishing pad. Thus, in one embodiment, each closed cell pore has a physical shell. In another embodiment, referring again to FIG. 11B, the mixing further includes injecting a gas 1124 into to the pre-polymer 1102 and the curative 1104, or into a product formed there from, to provide closed cell pores in the ultimately formed polishing pad. Thus, in one embodiment, each closed cell pore has no physical shell. In a combination embodiment, the mixing further includes adding a plurality of porogens 1122 to the pre-polymer 1102 and the curative 1104 to provide a first portion of closed cell pores each having a physical shell, and further injecting a gas 1124 into the pre-polymer 1102 and the curative 1104, or into a product formed there from, to provide a second portion of closed cell pores each having no physical shell. In yet another embodiment, the pre-polymer 1102 is an isocyanate and the mixing further includes adding water ($H_2O$) to the pre-polymer 1102 and the curative 1104 to provide closed cell pores each having no physical shell.

Thus, groove patterns contemplated in embodiment of the present invention may be formed in-situ. For example, as described above, a compression-molding process may be used to form polishing pads with a grooved polishing surface having a pattern of concentric polygons. By using a molding process, highly uniform groove dimensions within-pad may be achieved. Furthermore, extremely reproducible groove dimensions along with very smooth, clean groove surfaces may be produced. Other advantages may include reduced defects and micro-scratches and a greater usable groove depth.

Individual grooves of the concentric polygon groove patterns described herein may be from about 4 to about 100 mils deep at any given point on each groove. In some embodiments, the grooves are about 10 to about 50 mils deep at any given point on each groove. The grooves may be of uniform depth, variable depth, or any combinations thereof. In some embodiments, the grooves are all of uniform depth. For example, the grooves of a concentric polygon pattern may all have the same depth. In some embodiments, some of the grooves of a concentric polygon pattern may have a certain uniform depth while other grooves of the same pattern may have a different uniform depth. For example, groove depth may increase with increasing distance from the center of the polishing pad. In some embodiments, however, groove depth decreases with increasing distance from the center of the polishing pad. In some embodiments, grooves of uniform depth alternate with grooves of variable depth.

Individual grooves of the concentric polygon groove patterns described herein may be from about 2 to about 100 mils wide at any given point on each groove. In some embodiments, the grooves are about 15 to about 50 mils wide at any given point on each groove. The grooves may be of uniform width, variable width, or any combinations thereof. In some embodiments, the grooves of a concentric polygon pattern are all of uniform width. In some embodiments, however, some of the grooves of a concentric polygon pattern have a certain uniform width, while other grooves of the same pattern have a different uniform width. In some embodiments, groove width increases with increasing distance from the center of the polishing pad. In some embodiments, groove width decreases with increasing distance from the center of the polishing pad. In some embodiments, grooves of uniform width alternate with grooves of variable width.

In accordance with the previously described depth and width dimensions, individual grooves of the concentric polygon groove patterns described herein may be of uniform volume, variable volume, or any combinations thereof. In some embodiments, the grooves are all of uniform volume. In some embodiments, however, groove volume increases with increasing distance from the center of the polishing pad. In some other embodiments, groove volume decreases with increasing distance from the center of the polishing pad. In some embodiments, grooves of uniform volume alternate with grooves of variable volume.

Grooves of the concentric polygon groove patterns described herein may have a pitch from about 30 to about 1000 mils. In some embodiments, the grooves have a pitch of about 125 mils. For a circular polishing pad, groove pitch is measured along the radius of the circular polishing pad. In CMP belts, groove pitch is measured from the center of the CMP belt to an edge of the CMP belt. The grooves may be of uniform pitch, variable pitch, or in any combinations thereof. In some embodiments, the grooves are all of uniform pitch. In some embodiments, however, groove pitch increases with increasing distance from the center of the polishing pad. In some other embodiments, groove pitch decreases with increasing distance from the center of the polishing pad. In some embodiments, the pitch of the grooves in one sector varies with increasing distance from the center of the polishing pad while the pitch of the grooves in an adjacent sector remains uniform. In some embodiments, the pitch of the grooves in one sector increases with increasing distance from the center of the polishing pad while the pitch of the grooves in an adjacent sector increases at a different rate. In some embodiments, the pitch of the grooves in one sector increases with increasing distance from the center of the polishing pad while the pitch of the grooves in an adjacent sector decreases with increasing distance from the center of the polishing pad. In some embodiments, grooves of uniform pitch alternate with grooves of variable pitch. In some embodiments, sectors of grooves of uniform pitch alternate with sectors of grooves of variable pitch.

It is to be understood that embodiments of the present invention may also include groupings of polygons that are not precisely concentric. In such embodiments, increasingly larger polygons are provided, but the center for each individual polygon need not necessarily align exactly with the center of a preceding or successive polygon. Nonetheless, such near-concentric or approximately concentric polygons are considered to be within the spirit and scope of the present invention.

It is also to be understood that embodiments of the present invention may include polygons where, for an individual polygon, either the edge lengths are not all the same, the angles between edges are not all the same, or both. As an example, FIG. 12 illustrates a top-down plan view of a concentric polygon groove pattern, with distorted polygons, disposed in the polishing surface of a polishing pad, in accordance with an embodiment of the present invention.

Figure 12:
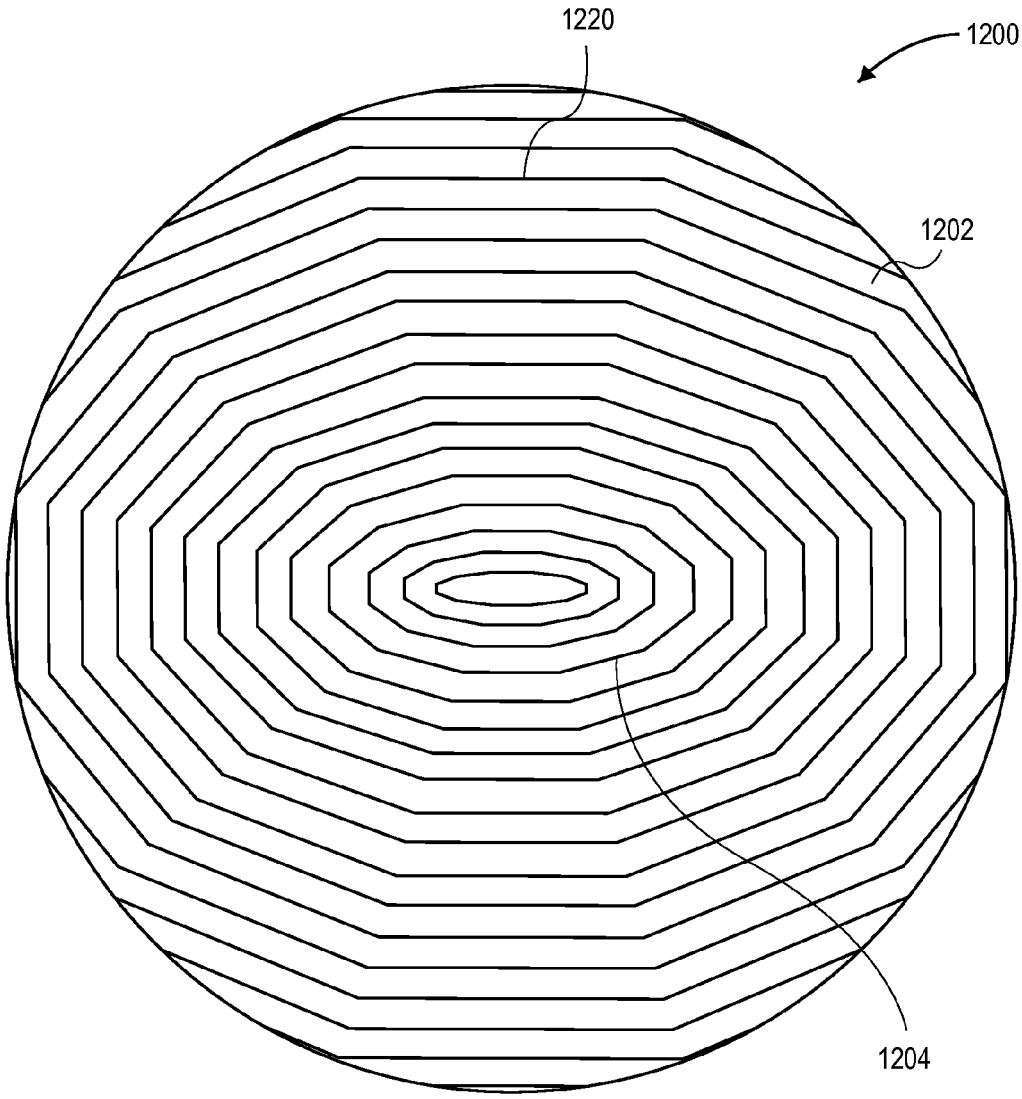
FIG. 12 illustrates a top-down plan view of a concentric polygon groove pattern, with distorted polygons, disposed in the polishing surface of a polishing pad, in accordance with an embodiment of the present invention.

Referring to FIG. 12, a polishing pad 1200 includes a polishing body having a polishing surface 1202 and a back surface (not shown). The polishing surface 1202 has a pattern of grooves of concentric distorted polygons. For example, in an embodiment, the pattern of grooves of concentric polygons is a pattern of grooves of concentric distorted dodecagons 1204, as depicted in FIG. 12. Since the polygons are distorted, it is to be understood that the outer edges of the polishing pad 1200 may not be able to accommodate complete polygons. However, there may be a need to include grooves at the outer most reaches of polishing pad 1200. For example, in an embodiment, one or more partial polygons 1220 is included near or at the edge of polishing pad 1200, as is depicted in FIG. 12.

It is also to be understood that embodiments of the present invention may include groove patterns with continuity, e.g., with a spiral effect, of "open" or incomplete polygons that provide an overall feel or appearance of concentric polygons. For example, FIG. 13 illustrates a top-down plan view of a groove pattern having continuity between incomplete polygons with a general appearance of concentric polygons, disposed in the polishing surface of a polishing pad, in accordance with an embodiment of the present invention.

Figure 13:
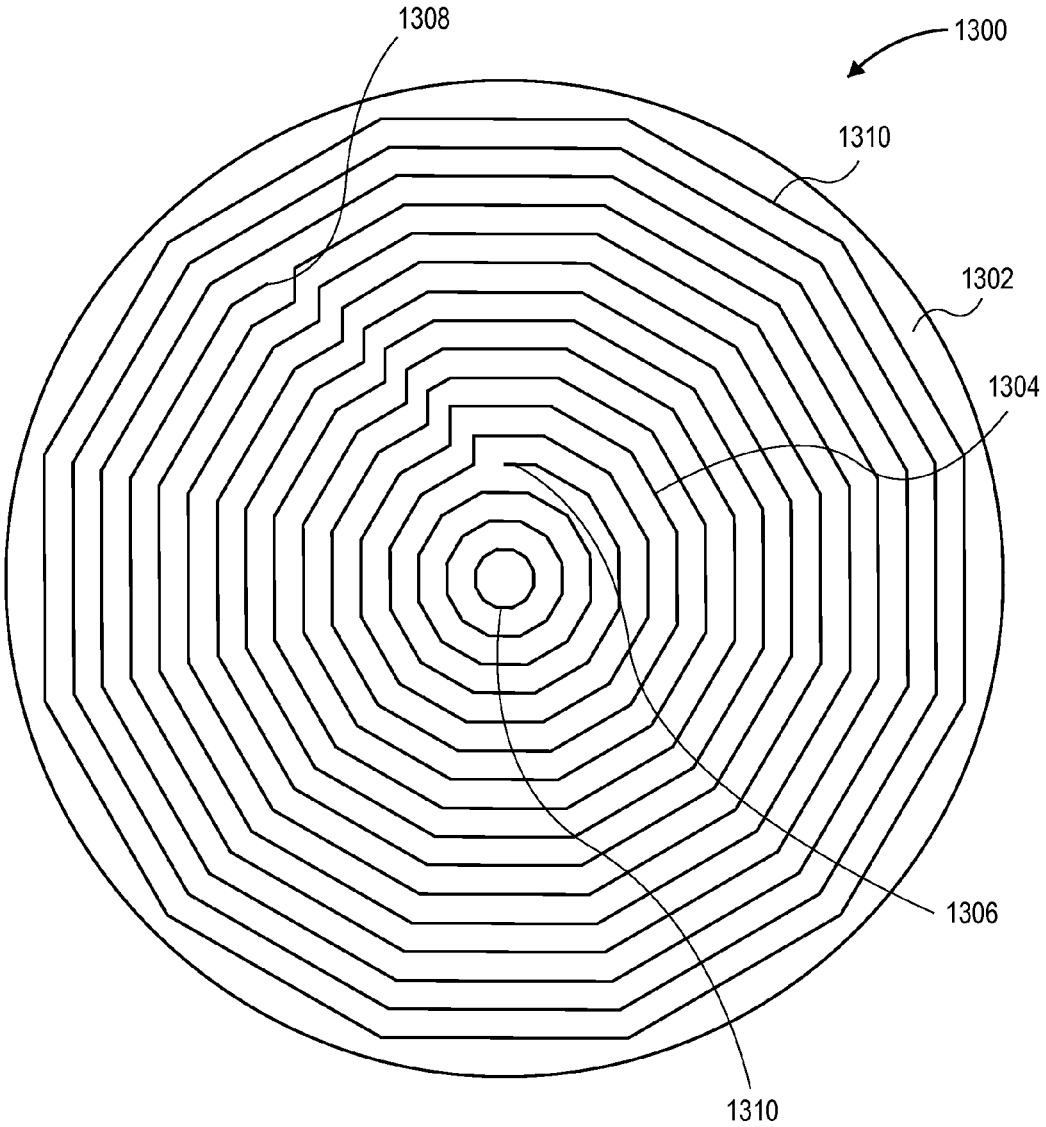
FIG. 13 illustrates a top-down plan view of a groove pattern having continuity between incomplete polygons with a general appearance of concentric polygons, disposed in the polishing surface of a polishing pad, in accordance with an embodiment of the present invention.

Referring to FIG. 13, a polishing pad 1300 includes a polishing body having a polishing surface 1302 and a back surface (not shown). The polishing surface 1302 has a pattern of grooves having continuity between incomplete polygons 1304. The overall arrangement of incomplete polygons with continuity there between 1304 gives a general appearance of concentric polygons. The arrangement may also be described as a spiral arrangement of incomplete polygons or a nested arrangement of continuous, yet incomplete polygons.

The polishing surface 1302 may, in an embodiment, include only incomplete polygons with continuity there between 1304. For example, the continuous pattern may begin at or near the center of the polishing surface 1302 and may end at or near the outer region of the polishing surface 1302. However, in another embodiment, only a portion of the polishing surface 1302 includes a groove pattern with incomplete polygons having continuity there between 1304. For example, referring again to FIG. 13, the continuous pattern 1304 begins away the center of the polishing surface 1302, e.g. at location 1306 and ends away from the outer region of the polishing surface 1302, e.g., at location 1308.

In an embodiment, the pattern of grooves including the pattern of nested incomplete polygons with continuity there between 1304 gives a general appearance of concentric dodecagons, as depicted in FIG. 13. The pattern is not formally a pattern of concentric polygons since the polygons are not complete. In such an arrangement, radial grooves may or may not be disposed along the radii of the incomplete polygons. In an embodiment, complete polygons, such as polygons 1310, may also be included in the pattern, e.g., at the inside of the incomplete polygons with continuity there between 1304, or at the outside of the incomplete polygons with continuity there between 1304, or both as is depicted in FIG. 13. In an embodiment, more than one pattern of nested incomplete polygons with continuity there between is included, e.g., a first smaller pattern of nested incomplete polygons with continuity there between surrounded by a second larger pattern of nested incomplete polygons with continuity there between. In another embodiment, each successive incomplete polygon is approached gradually as opposed to step-wise (a step-wise succession is depicted in FIG. 13). In such an embodiment, the trajectory of the pattern follows that of a true spiral, where the radius of the pattern increases at each inflection point of the incomplete polygons as the pattern turns from the inner most starting point to the outer most finishing point.

Thus, referring again to FIG. 13, in an embodiment, a polishing pad includes a polishing body having a polishing surface and a back surface. The polishing surface has a pattern of grooves including nested incomplete polygons having continuity there between. In one embodiment, the pattern of grooves has no radial groove. In one embodiment, the pattern of grooves has a radial groove along a radius of the polishing surface.

It is also to be understood that embodiments of the present invention may include groove patterns with groupings of discrete line segments that provide an overall feel or appearance of concentric polygons. For example, FIG. 14A illustrates a top-down plan view of a line segment groove pattern with a general appearance of concentric polygons without inflection points, disposed in the polishing surface of a polishing pad, in accordance with an embodiment of the present invention.

Figure 14B:
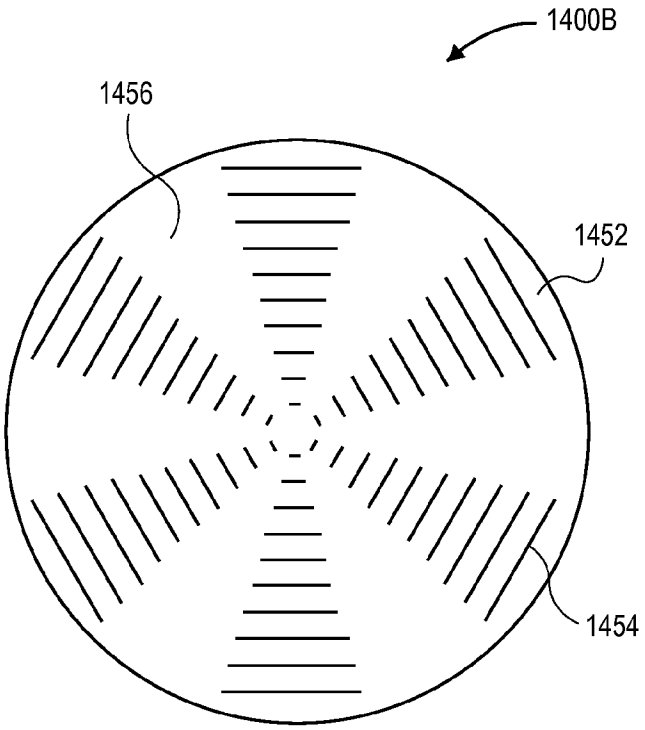
FIG. 14B illustrates a top-down plan view of a line segment groove pattern with a general appearance of concentric polygons without every other edge, disposed in the polishing surface of a polishing pad, in accordance with an embodiment of the present invention.
Figure 14A:
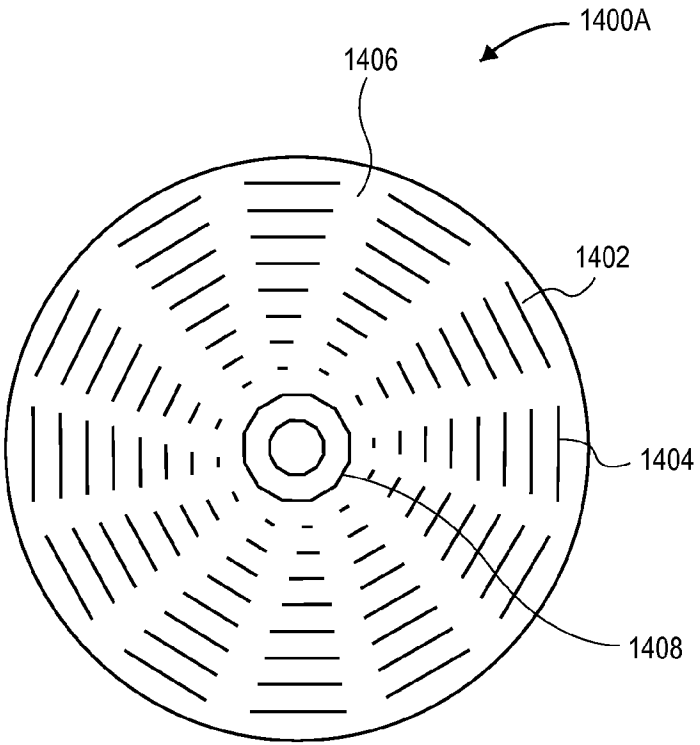
FIG. 14A illustrates a top-down plan view of a line segment groove pattern with a general appearance of concentric polygons without inflection points, disposed in the polishing surface of a polishing pad, in accordance with an embodiment of the present invention.

Referring to FIG. 14A, a polishing pad 1400A includes a polishing body having a polishing surface 1402 and a back surface (not shown). The polishing surface 1402 has a pattern of grooves of discrete line segments 1404. The overall arrangement of discrete line segments 1404 gives a general appearance of concentric polygons. For example, in an embodiment, the pattern of grooves of discrete line segments 1404 gives a general appearance of concentric dodecagons, as depicted in FIG. 14A. The pattern is not formally a pattern of concentric polygons since the inflection points (e.g., location 1406) are removed. In such an arrangement, radial grooves may or may not be disposed along the radii where the inflection points would otherwise be located. In one embodiment, distinguishing the pattern from the pattern depicted in and described in association with FIG. 2, the radial grooves do not touch the discrete line segments. In an embodiment, complete polygons, such as polygon 1408, may also be included in the pattern.

In another example, FIG. 14B illustrates a top-down plan view of a line segment groove pattern with a general appearance of concentric polygons without every other edge, disposed in the polishing surface of a polishing pad, in accordance with an embodiment of the present invention.

Referring to FIG. 14B, a polishing pad 1400B includes a polishing body having a polishing surface 1452 and a back surface (not shown). The polishing surface 1452 has a pattern of grooves of discrete line segments 1454. The overall arrangement of discrete line segments 1454 gives a general appearance of concentric polygons. For example, in an embodiment, the pattern of grooves of discrete line segments 1454 gives a general appearance of concentric dodecagons, as depicted in FIG. 14B. The pattern is not formally a pattern of concentric polygons since every other edge (e.g., location 1456) is removed from each polygon. In such an arrangement, radial grooves may or may not be disposed along the radii where the omitted edges would otherwise be located. In one embodiment, the radial grooves do not touch the discrete line segments. In another embodiment, only a slice or portion of every second edge is removed between inflection points, leaving a plurality of discrete line segment pairs, each pair joined by an inflection point.

Thus, referring again to FIGS. 14A and 14B, in an embodiment, a polishing pad includes a polishing body having a polishing surface and a back surface. The polishing surface has a pattern of grooves including a plurality of discrete linear segments orthogonal to radii of the polishing surface and forming a portion of a, but not a complete, concentric or approximately concentric polygon arrangement. In one embodiment, the portion of the concentric or approximately concentric polygon arrangement omits one or more inflection points from one or more of the polygons. In one embodiment, the portion of the concentric or approximately concentric polygon arrangement omits one or more edges from one or more of the polygons. In one embodiment, the pattern of grooves has no radial groove. In one embodiment, the pattern of grooves has a radial groove along a radius of the polishing surface, but not in contact with the plurality of discrete linear segments.

It is to be understood that embodiments of the present invention may also include discrete linear segments that are not precisely orthogonal to radii of the polishing surface. In such embodiments, the discrete linear segments form a portion of a, but not a complete, concentric or approximately concentric polygon arrangement, but the relative association with the corresponding radius in not precisely 90 degrees but rather, perhaps a fraction of a degree to a few degrees off of 90 degrees. Nonetheless, such near-orthogonal or approximately orthogonal discrete linear segments are considered to be within the spirit and scope of the present invention.

Polishing pads described herein may be suitable for use with a variety of chemical mechanical polishing apparatuses. As an example, FIG. 15 illustrates an isometric side-on view of a polishing apparatus compatible with a polishing pad having a concentric polygon groove pattern, in accordance with an embodiment of the present invention.

Figure 15:
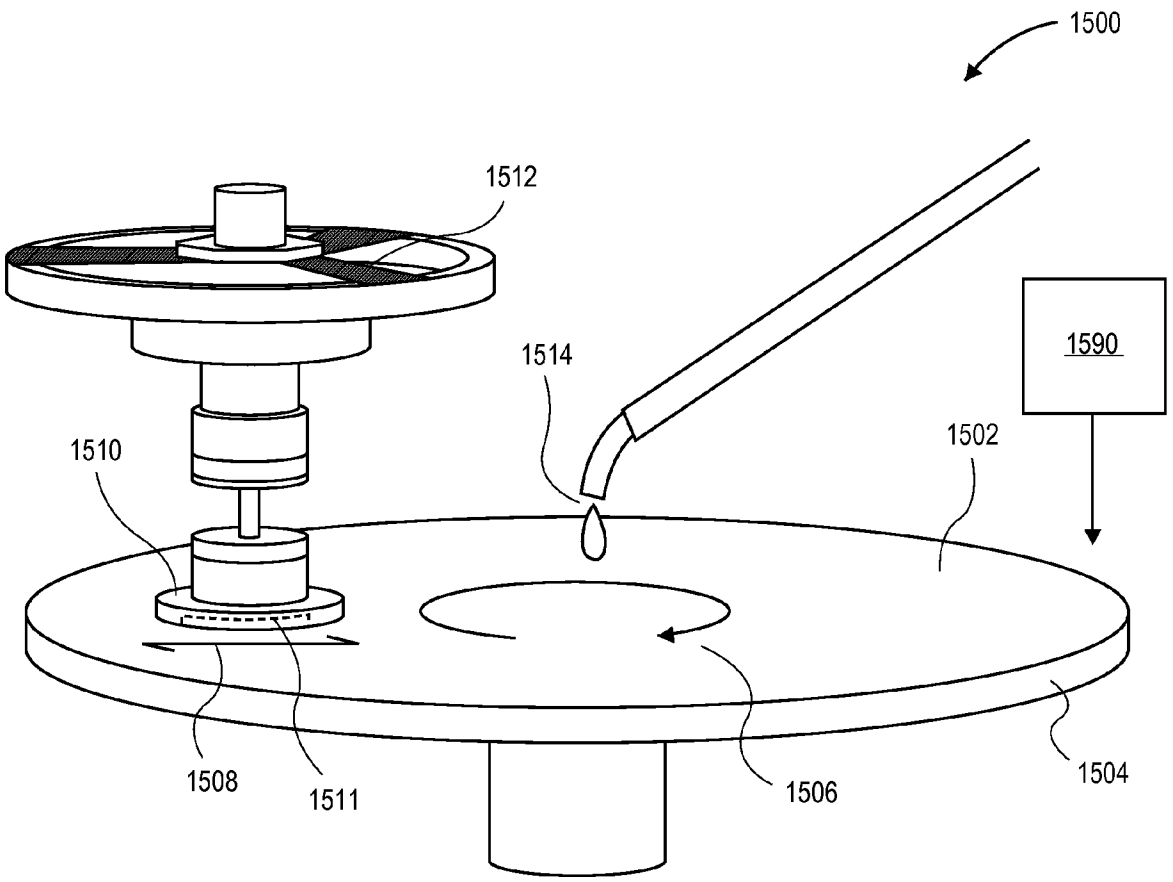
FIG. 15 illustrates an isometric side-on view of a polishing apparatus compatible with a polishing pad having a concentric polygon groove pattern, in accordance with an embodiment of the present invention.

Referring to FIG. 15, a polishing apparatus 1500 includes a platen 1504. The top surface 1502 of platen 1504 may be used to support a polishing pad with a concentric or approximately concentric polygon groove pattern. Platen 1504 may be configured to provide spindle rotation 1506 and slider oscillation 1508. A sample carrier 1510 is used to hold, e.g., a semiconductor wafer 1511 in place during polishing of the semiconductor wafer with a polishing pad. Sample carrier 1510 is further supported by a suspension mechanism 1512. A slurry feed 1514 is included for providing slurry to a surface of a polishing pad prior to and during polishing of the semiconductor wafer. A conditioning unit 1590 may also be included and, in one embodiment, includes a diamond tip for conditioning a polishing pad.

Thus, polishing pads with concentric or approximately concentric polygon groove patterns have been disclosed. In accordance with an embodiment of the present invention, a polishing pad for polishing a substrate includes a polishing body. The polishing body has a polishing surface and a back surface, the polishing surface having a pattern of grooves including concentric or approximately concentric polygons. The pattern of grooves has no radial groove continuous from the inner most polygon to the outer most polygon. In one embodiment, each of the polygons has the same number of edges, the number of edges determined by the diameter of the polishing pad or by the diameter of the substrate. In one embodiment, the pattern of grooves has no radial grooves.

What is claimed is:

1. A polishing pad for polishing a substrate, the polishing pad comprising:

a polishing body having a polishing surface and a back surface, the polishing surface having a pattern of grooves comprising concentric or approximately concentric polygons, the pattern of grooves having no radial groove continuous from the inner most polygon to the outer most polygon, wherein all internal angles of each polygon are greater than 90 degrees, wherein each of the polygons has the same number of edges, and wherein the number of edges is determined by the diameter of the polishing pad or by the diameter of the substrate.

2. The polishing pad of claim 1, wherein the diameter of the polishing pad is approximately 30 inches, the diameter of the substrate is approximately 12 inches, and the polygons are hexadecagons.

3. The polishing pad of claim 1, wherein the diameter of the polishing pad is approximately 20 inches, the diameter of the substrate is approximately 8 inches, and the polygons are decagons.

4. The polishing pad of claim 1, wherein the length of each edge of the outer most polygon is approximately in the range of 50-60% of the length of the diameter of the substrate.

5. The polishing pad of claim 1, wherein the pattern of grooves has no radial grooves.

6. The polishing pad of claim 1, wherein the pattern of grooves further comprises a radial groove between two successive polygons of the concentric or approximately concentric polygons.

7. The polishing pad of claim 1, wherein each polygon of the concentric or approximately concentric polygons has no degree of rotation relative to its successive polygon.

8. The polishing pad of claim 1, wherein one or more of the polygons has a degree of rotation relative to its successive polygon.

9. The polishing pad of claim 8, wherein the degree of rotation is determined by the total number of concentric or approximately concentric polygons in the pattern of grooves.

10. The polishing pad of claim 8, wherein the one or more polygons has a clockwise rotation relative to the successive polygon.

11. The polishing pad of claim 8, wherein the one or more polygons has a counter-clockwise rotation relative to the successive polygon.

12. The polishing pad of claim 1, wherein the polygons are concentric and the center of the concentric polygons is located at the center of the polishing pad.

13. The polishing pad of claim 1, wherein the polygons are concentric and the center of the concentric polygons is offset from the center of the polishing pad.

14. The polishing pad of claim 1, wherein the pattern of grooves further comprises one or more circular grooves interrupting the concentric polygons, the polygons are concentric, and the center of each circular groove is located at the center of the concentric polygons.

15. The polishing pad of claim 1, wherein one or more of the polygons is distorted.

16. The polishing pad of claim 1, further comprising:

a local area transparency (LAT) region disposed in the polishing body, the LAT region interrupting the pattern of grooves.

17. The polishing pad of claim 1, the polishing surface further comprising an indication region indicating the location of a detection region disposed in the back surface of the polishing pad, the indication region interrupting the pattern of grooves.

18. The polishing pad of claim 1, wherein the polishing body is a homogeneous polishing body comprising a thermoset polyurethane material.

19. The polishing pad of claim 1, wherein the polishing body is a molded polishing body.

* * * * *